US011383521B2

(12) United States Patent
Nakamura

(10) Patent No.: US 11,383,521 B2
(45) Date of Patent: Jul. 12, 2022

(54) APPARATUS CONFIGURED TO DISCHARGE LIQUID

(71) Applicant: Daisuke Nakamura, Kanagawa (JP)

(72) Inventor: Daisuke Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 16/806,675

(22) Filed: Mar. 2, 2020

(65) Prior Publication Data

US 2020/0282728 A1 Sep. 10, 2020

(30) Foreign Application Priority Data

Mar. 4, 2019 (JP) ..... JP2019-038924
Feb. 14, 2020 (JP) ..... JP2020-023672

(51) Int. Cl.

*B41J 2/175* (2006.01)
*B41J 2/135* (2006.01)
*B41J 25/316* (2006.01)
*B41J 2/23* (2006.01)

(52) U.S. Cl.

CPC ..... *B41J 2/1752* (2013.01); *B41J 2/135* (2013.01); *B41J 2/23* (2013.01); *B41J 25/316* (2013.01)

(58) Field of Classification Search

CPC ..... B41J 2/14; B41J 2/42; B41J 2/135; B41J 2/175; B41J 2/1752; B41J 2/17523; B41J 25/304; B41J 29/02; B41J 2202/19; B41J 2202/20; B41J 2025/008

See application file for complete search history.

(56) References Cited

U.S. PATENT DOCUMENTS

| | | | | |
|---|---|---|---|---|
| 2008/0291240 | A1 | 11/2008 | Ohsako et al. | |
| 2011/0141209 | A1 | 6/2011 | Tsukamura et al. | |
| 2011/0228016 | A1 | 9/2011 | Nakamura | |
| 2012/0056953 | A1 | 3/2012 | Nakamura | |
| 2013/0155158 | A1 | 6/2013 | Tsukamura et al. | |
| 2013/0286061 | A1 | 10/2013 | Nakamura | |
| 2014/0079461 | A1 | 3/2014 | Obata et al. | |
| 2015/0109386 | A1* | 4/2015 | Koike | B41J 2/17513 347/86 |
| 2018/0056657 | A1* | 3/2018 | Murakami | B41J 2/17523 |

FOREIGN PATENT DOCUMENTS

| | | | |
|---|---|---|---|
| DE | 102017114280 | * 12/2018 | B41J 3/4073 |
| JP | 2005-059274 | 3/2005 | |
| JP | 2013-226721 | 11/2013 | |
| JP | 2016-083789 | 5/2016 | |
| JP | 2017-209844 | 11/2017 | |

* cited by examiner

*Primary Examiner* — Anh T Vo
(74) *Attorney, Agent, or Firm* — Duft & Bornsen, PC

(57) ABSTRACT

An apparatus configured to discharge liquid includes a plurality of liquid discharge modules arranged at different inclinations in the apparatus. Each of the plurality of liquid discharge modules includes a liquid discharge head, a containing member, and a holding member. The liquid discharge head is configured to discharge liquid. The containing member is configured to contain liquid to be supplied to the liquid discharge head. The holding member is configured to hold the containing member. The holding member of each of the plurality of liquid discharge modules includes a first adjuster configured to adjust a position of the containing member relative to the liquid discharge head in a vertical direction in the apparatus.

15 Claims, 15 Drawing Sheets

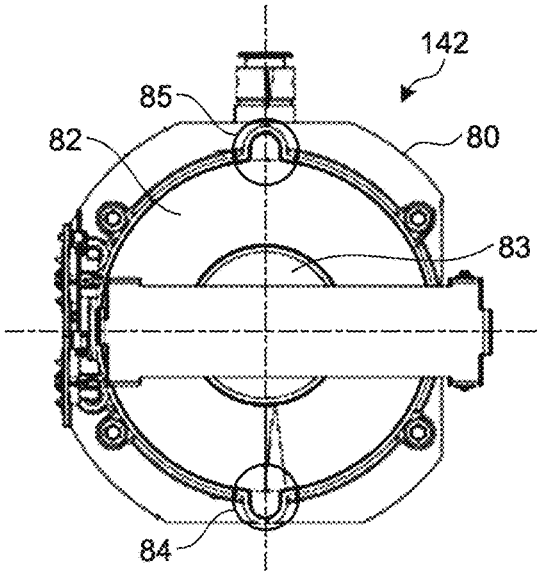
FIG.3A
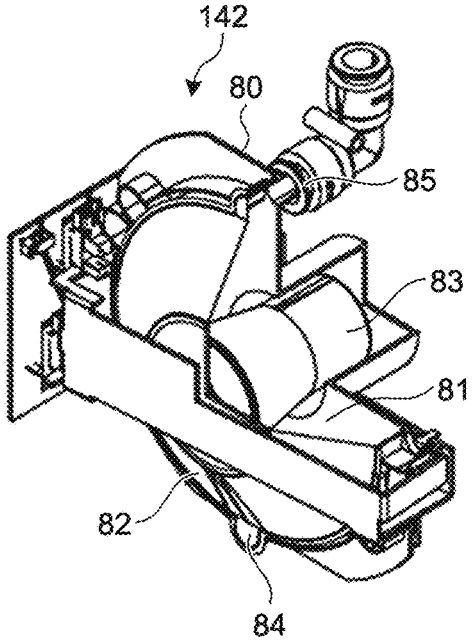
FIG.3B
FIG.4
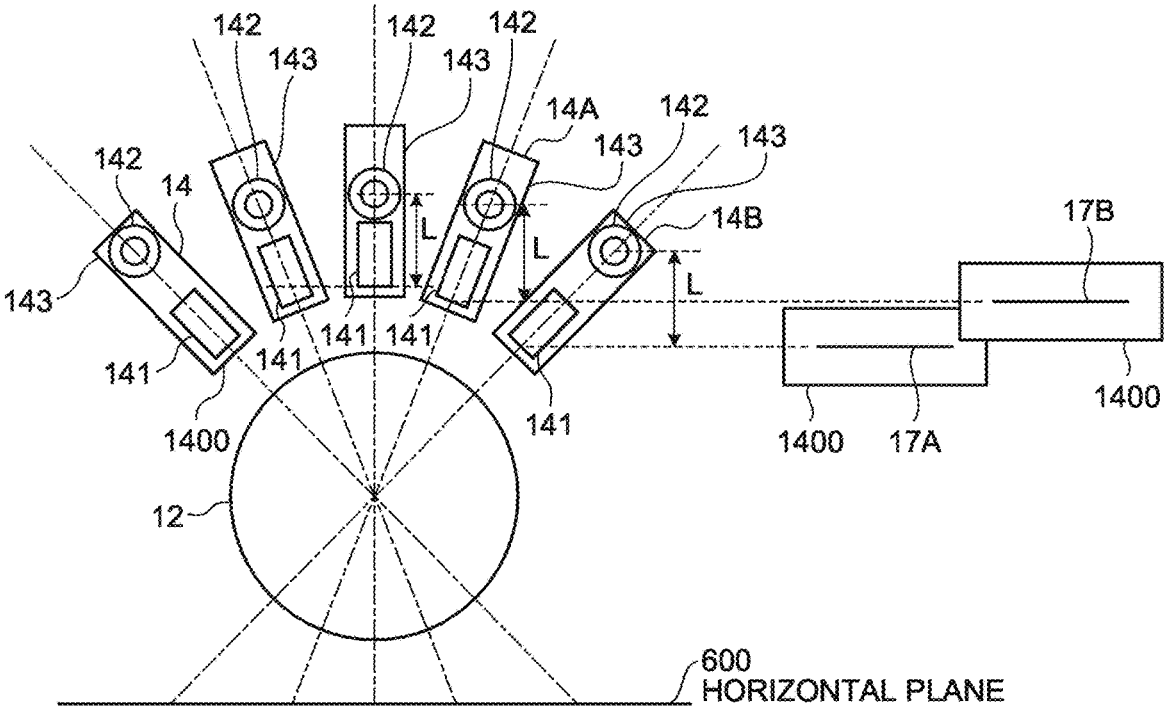

APPARATUS CONFIGURED TO DISCHARGE LIQUID

CROSS-REFERENCE TO RELATED APPLICATIONS

The present application claims priority under 35 U.S.C. § 119 to Japanese Patent Application No. 2019-038924, filed on Mar. 4, 2019, and Japanese Patent Application No. 2020-023672, filed on Feb. 14, 2020. The contents of which are incorporated herein by reference in their entirety.

BACKGROUND OF THE INVENTION

1. Field of the Invention

The present invention relates to an apparatus configured to discharge liquid.

2. Description of the Related Art

Conventionally, an inkjet recording apparatus forms an image by discharging ink liquid in the form of droplets from liquid discharge heads onto a conveyed recording sheet.

The ink liquid is supplied to each of the liquid discharge heads by generating negative pressure in a sub tank to which the ink liquid is supplied from a main tank. For example, Japanese Unexamined Patent Application Publication No. 2017-209844 discloses a configuration in which a sub tank is arranged for each of two head arrays that are arranged in a zig-zag manner on an array base such that orientations of head surfaces are aligned. In the configuration disclosed in Japanese Unexamined Patent Application Publication No. 2017-209844, if the head arrays are arranged so as to be inclined together with the array base, a hydraulic head difference occurs between the two arrays that are arranged in a zig-zag manner on the array base; therefore each of the sub tanks is arranged at an appropriate height position in a vertical direction.

However, when various droplets are to be discharged onto a recording sheet placed on a curved surface, such as a conveying drum, each of liquid discharge heads that are used for different kinds of liquid, such as different ink colors, to be discharged is arranged so as to face the curved surface at a different inclination in accordance with the curved surface. Therefore, the hydraulic head difference varies between heads that are arranged at different inclinations. Consequently, quality of images that are formed in accordance with the positions of the head arrays used to form the images vary, which is a problem.

The present invention has been conceived in view of the foregoing situations, and an object of the present invention is to provide an apparatus configured to discharge liquid, where the apparatus is capable of preventing, with a simple configuration, variation in quality of images that are formed in accordance with different inclinations of liquid discharge heads.

SUMMARY OF THE INVENTION

According to an aspect of the present invention, an apparatus configured to discharge liquid includes a plurality of liquid discharge modules arranged at different inclinations in the apparatus. Each of the plurality of liquid discharge modules includes a liquid discharge head, a containing member, and a holding member. The liquid discharge head is configured to discharge liquid. The containing member is configured to contain liquid to be supplied to the liquid discharge head. The holding member is configured to hold the containing member. The holding member of each of the plurality of liquid discharge modules includes a first adjuster configured to adjust a position of the containing member relative to the liquid discharge head in a vertical direction in the apparatus.

BRIEF DESCRIPTION OF THE DRAWINGS

FIGS. 3A and 3B are diagrams illustrating an example of a configuration of a single sub tank;

FIG. 4 is a diagram for explaining mounting positions of the sub tanks in the liquid discharge modules;

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
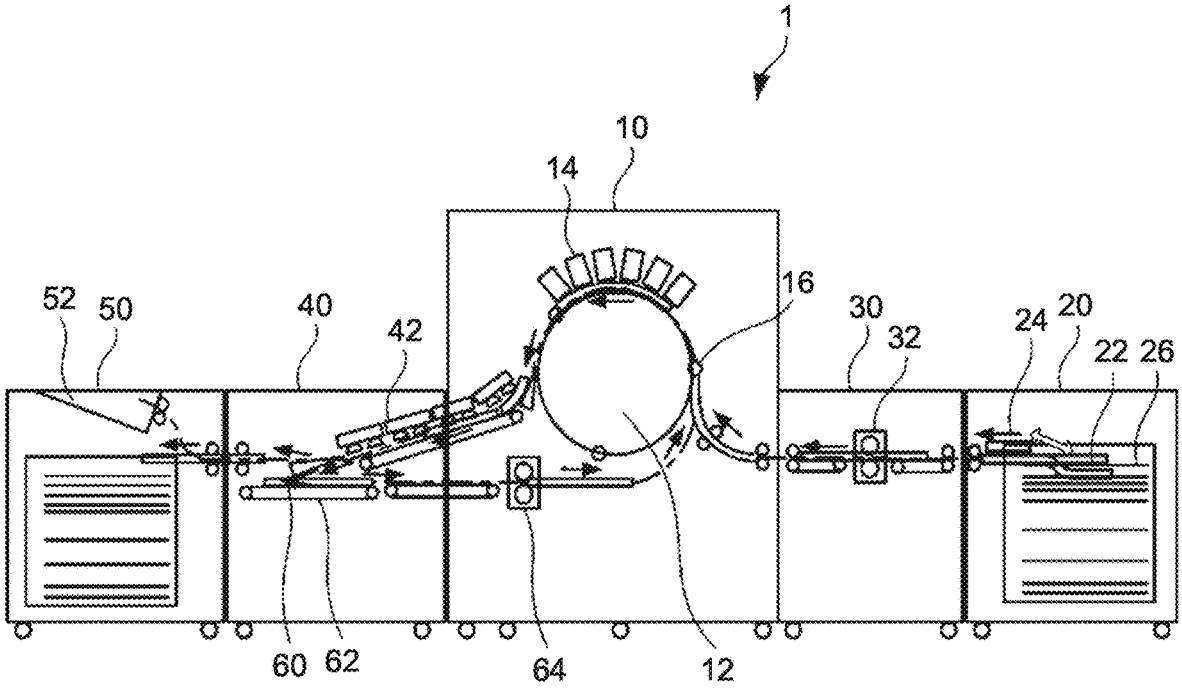
FIG. 1 is a diagram illustrating an example of an entire configuration of an apparatus configured to discharge liquid according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

Exemplary embodiments of an apparatus configured to discharge liquid will be described in detail below with reference to the drawings. The embodiments described below are mere examples and not limited thereto.

Embodiment

In the present application, a "liquid discharge head" is a functional component that discharges and ejects liquid from a nozzle. The liquid to be discharged is not specifically limited as long as the liquid has a viscosity and surface tension that allow the liquid to be discharged from the head; however, it is preferable that the liquid has a viscosity of 30 mPa/s or below when heated and cooled under normal temperature and normal pressure. More specifically, the liquid may be a solution, a suspension, an emulsion, or the like that contains a solvent such as water or an organic solvent, a colorant such as a dye or a pigment, a function providing material such as a polymerizable compound, a resin, or a surfactant, a biomaterial such as DNA, amino acid, protein, or calcium, or an edible material such as a natural pigment, and, the liquid may be used for uses such as ink for inkjet, a surface treatment liquid, a liquid for forming a constituent element of an electron element or a light-emitting element or for forming an electronic circuit resist pattern, and a material liquid for three-dimensional modeling.

In the present application, the "apparatus configured to discharge liquid" is an apparatus that includes a liquid discharge head or a liquid discharge unit, and drives the liquid discharge head to discharge liquid. The apparatus configured to discharge liquid includes not only an apparatus that is able to discharge liquid to a target to which liquid can adhere, but also an apparatus that discharges liquid into the air or liquid.

The "apparatus configured to discharge liquid" may further include means related to feed, convey, and eject a target to which liquid can adhere, and include a pre-processing apparatus, a post-processing apparatus, and the like.

For example, the "apparatus configured to discharge liquid" may be an image forming apparatus that is an apparatus for forming an image by discharging ink onto a sheet, and a stereoscopic modeling device (three-dimensional modeling device) that models a stereoscopic modeled object (three-dimensional modeled object) by discharging modeling liquid onto powder layers in which powders are laminated.

Further, the "apparatus configured to discharge liquid" is not limited to an apparatus by which a significant image, such as a character or a graphic, is visualized by discharged ink. For example, an apparatus that forms a pattern or the like that does not have a meaning in itself and an apparatus that models a three-dimensional image may be adopted.

The "target to which liquid can adhere (corresponding to a "discharge target")" is an object to which liquid can adhere at least temporarily, and represents an object to which liquid adheres and sticks, an object to which liquid adheres and penetrates, and the like. Specifically, the target includes all of objects to which liquid adheres, such as a target recording medium including a sheet, a recording paper, a recording sheet, a film, a cloth, and the like, an electronic component including an electronic substrate, a piezoelectric element, and the like, and a medium including a powder layer (powdered layer), an organ model, an examination cell, and the like, unless specifically limited.

A material of the "target to which liquid can adhere" may be any material, such as paper, thread, fiber, fabric cloth, leather, metal, plastic, glass, wood, or ceramics, to which liquid can adhere at least temporarily.

Furthermore, the "apparatus configured to discharge liquid" is an apparatus in which the liquid discharge head and the target to which liquid can adhere move relative to each other, but is not limited thereto. Specifically, a serial-type apparatus that moves the liquid discharge head, a linear-type apparatus that does not move the liquid discharge head, and the like may be adopted.

Moreover, the "apparatus configured to discharge liquid" includes a treatment liquid applying apparatus that discharges treatment liquid onto a sheet to apply the treatment liquid to a surface of the sheet in order to modify the surface of the sheet, a jet granulation apparatus that ejects composition liquid that is obtained by dispersing raw materials in a solution, and forms fine grains of the raw materials through granulation.

The "liquid discharge unit" is a unit in which functional components/mechanisms are integrated with the liquid discharge head, and is an assembly of components related to discharging of liquid. The "liquid discharge unit" is constructed by combining at least a containing member, such as a sub tank, and a holding member for holding the containing member with the liquid discharge head. The containing member contains liquid to be supplied to the liquid discharge head.

Here, integration includes, for example, a state in which the liquid discharge head and the functional components/mechanisms are fixed together by fastening, bonding, engaging, or the like, and a state in which one of the liquid discharge head and the functional components/mechanisms is held so as to be movable relative to the other one of them. Furthermore, the liquid discharge head and the functional components/mechanisms may be configured so as to be detachably attached to each other.

The "apparatus configured to discharge liquid" according to the embodiments will be described below by taking an image forming apparatus as an example. Meanwhile, three-dimensional orthogonal coordinate axes (an X-axis, a Y-axis, and a Z-axis) set in each of the drawings will be appropriately referred to in the explanation.

Entire Configuration

An image forming apparatus 1 illustrated in FIG. 1 includes a sheet feed unit 20, a registration adjusting unit 30, an image forming unit 10, a drying unit 40, and a paper ejection unit 50. The image forming apparatus 1 includes a conveying means that is arranged over all of the units from the sheet feed unit 20 to the paper ejection unit 50 and that conveys a recording sheet 22 as one example of a discharge target from the sheet feed unit 20 to the paper ejection unit 50. As illustrated in FIG. 1, the image forming apparatus 1 includes various means along a conveying path of the recording sheet 22. The image forming apparatus 1 performs a series of operation for forming an image on the recording sheet 22 by controlling the conveying means and the various means. Each of the units illustrated in FIG. 1 will be described in detail below.

The sheet feed unit 20 includes a sheet feed tray 26 in which the recording sheets 22 are stacked, and a supply means that supplies the recording sheets 22 one by one to the registration adjusting unit 30. In FIG. 1, an example is illustrated in which an air separation unit 24 that separates the recording sheets 22 from one another by an air method is illustrated. The air separation unit 24 blows air to a bundle of the recording sheets 22, so that the recording sheets 22 are separated from one another. The recording sheets 22 that are separated from one another are picked up one by one by a pick-up roller of the supply means and supplied to the registration adjusting unit 30. A method for separating the recording sheets 22 is not limited to the air method, but an arbitrary method may be used. For example, it may be possible to use a method in which the recording sheets 22 that are picked up as a bundle by the pick-up roller are separated from one another by a separation roller.

The registration adjusting unit 30 includes a registration roller 32. The registration roller 32 adjusts registration (adjusts timing) of the recording sheet 22 fed from the sheet feed unit 20, and feeds the recording sheet 22 to the image forming unit 10.

The image forming unit 10 includes a conveying drum 12 that adsorbs the recording sheet 22 and feeds the recording sheet 22 in a single direction, and a plurality of liquid discharge modules (one example of the "liquid ejection unit") 14 that discharge droplets (described as ink droplets as one example) onto the recording sheet 22 to form an image.

The conveying drum 12 has a cylindrical shape, and a portion represented by a circular shape in FIG. 1 corresponds to a top surface portion of the cylinder. An outer periphery (corresponding to a "conveying surface") provided on a side surface portion of the cylinder is formed in a depth direction of a sheet surface along a circumference of the circle of the top surface portion, and makes an entire loop along the circumference of the circle. The conveying drum 12 holds a leading end of the recording sheet 22 fed from the registration adjusting unit 30 by using a sheet clamper 16 and rotates in a counterclockwise direction in the example illustrated in FIG. 1. The conveying drum 12 includes a plurality of air suction holes on the outer periphery, and rotates while sucking a back surface side of the recording sheet 22 by using a suction pump. The conveying drum 12 causes the recording sheet 22 to come into close contact with the outer periphery of the conveying drum 12, and conveys the recording sheet 22 in the counterclockwise direction along the outer periphery. Namely, in this example, a shape of a curved surface of the outer periphery corresponds to a shape of a surface on which the recording sheet 22 is placed.

Each of the liquid discharge modules 14 includes a liquid discharge head that discharges liquid (ink liquid in this example), a containing member that contains ink liquid to be supplied to the liquid discharge head, and a holding member that holds the containing member. Each of the liquid discharge heads includes one or a plurality of arrays of nozzle holes (nozzle arrays) that are arranged in a line in the depth direction of the sheet surface in FIG. 1. Each of the liquid discharge modules 14 discharges liquid from the nozzle array of each of the liquid discharge heads onto the recording sheet 22 that is conveyed by the conveying drum 12, so that an image is formed. In the example illustrated in FIG. 1, the sheet clampers 16 are arranged at three positions on the outer circumference of the conveying drum 12. Therefore, it is possible to form images on the three recording sheets 22 by single rotation of the conveying drum 12. Details of the liquid discharge modules 14 will be described later with reference to the drawings.

The drying unit 40 includes a drier unit 42. The drier unit 42 dries the recording sheet 22 that carries the formed image and that is conveyed from the image forming unit 10, and prevents the recording sheet 22 from being curled. By causing the recording sheet 22 to pass through the drier unit 42, moisture of ink evaporates and the recording sheet 22 is dried.

In the example illustrated in FIG. 1, a mechanism that deals with duplex printing is included. If the duplex printing is to be performed, a conveying direction is changed to a direction toward the image forming unit 10 by causing a sheet reversing unit 60 to reverse the recording sheet 22 that has been dried, and the sheet reversing unit 60 feeds the reversed recording sheet 22 to the image forming unit 10. The recording sheet 22 fed to the image forming unit 10 is fed to the conveying drum 12 again to form an image on a back side, after timing is adjusted by a registration roller 64 just before the recording sheet 22 is fed to the conveying drum 12.

The paper ejection unit 50 includes a discharge tray 52 on which the recording sheet 22 ejected from the drying unit 40 is stacked. The discharge tray 52 includes a pair of side fences that control a width direction of the recording sheet 22 and an end fence that controls a leading end of the recording sheet 22.

Liquid Discharge Module of First Embodiment

A configuration of the liquid discharge module 14 according to the first embodiment will be described in detail below. The liquid discharge module 14 according to the first embodiment includes the liquid discharge head, the containing member that contains liquid to be supplied to the liquid discharge head, and a holding member 143 (see FIG. 2). As the containing member, a sub tank 142 (see FIG. 2), in which when ink liquid gets low, ink liquid is fed with pressure from the main tank to replenish the ink liquid, will be described as an example.

Figure 2:
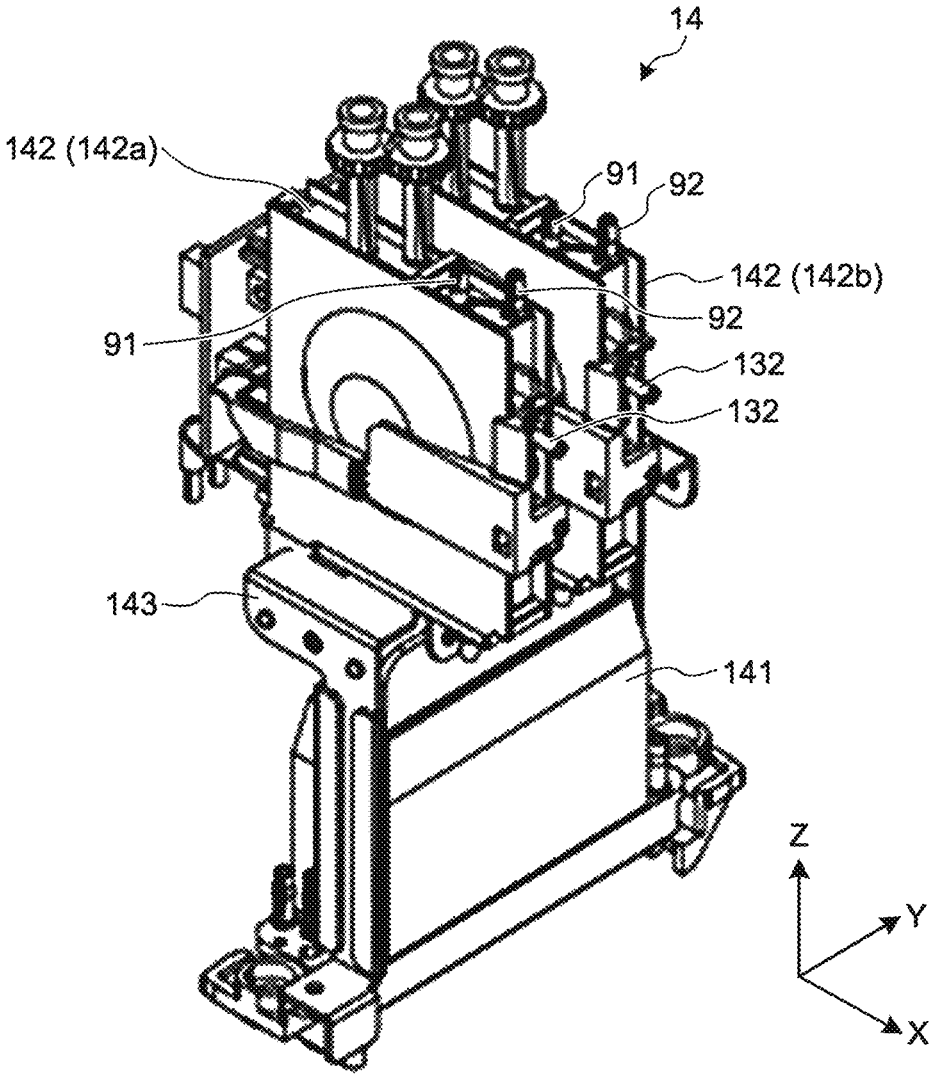
FIG. 2 is an external perspective view illustrating an example of a configuration of a liquid discharge module according to a first embodiment.

FIG. 2 is an external perspective view illustrating an example of the liquid discharge module according to the first embodiment. The liquid discharge module 14 illustrated in FIG. 2 includes a liquid discharge head 141, the sub tank 142, and the holding member 143. The holding member 143 is a member that fixes the sub tank 142 at a predetermined position relative to the liquid discharge head 141. While not illustrated in FIG. 2, at the time of use, an ink tube for transmitting the ink liquid from the main tank to the sub tank 142, an ink tube for transmitting the ink liquid from the sub tank 142 to the liquid discharge head 141, and the like are connected.

In the liquid discharge module 14 illustrated in FIG. 2, a discharge surface of the liquid discharge head 141 is located at a lower end surface (in the negative Z direction), i.e., at bottom. Although the discharge surface is not illustrated because it is located at bottom in FIG. 2, nozzle holes are arranged in a line in the positive Y direction on the discharge surface. Further, a plurality of (for example, two) nozzle arrays are arranged parallel to each other on the discharge surface. The liquid discharge module 14 includes, as one example of the liquid discharge head 141, a component configured to supply first ink liquid from a first supply port to a first nozzle array and supply second ink liquid from a second supply port to a second nozzle array. The first ink liquid and the second ink liquid may be the same ink liquid or may be different kinds of ink liquid.

A first sub tank 142*a* and a second sub tank 142*b* supply ink liquid into the liquid discharge head 141 from corresponding supply ports (a first supply port and a second supply port). The ink liquid is discharged in the form of droplets from different nozzle arrays (a first nozzle array and a second nozzle array) through flow paths, liquid chambers, or the like that are separated from each other inside the liquid discharge head 141.

The first sub tank 142*a* and the second sub tank 142*b* illustrated in FIG. 2 are mounted by the holding member 143 such that positions (for example, heights or the like) and postures (orientations) relative to the liquid discharge head 141 become the same. For example, when viewed in an XZ plane illustrated in FIG. 2, center positions overlap with each other and the postures are the same. In the example illustrated in FIG. 2, the first sub tank 142*a* and the second sub tank 142*b* are mounted such that holding positions are located at the same height from the liquid discharge head 141 and respective flexible films face a direction along which the nozzles are arranged on the discharge surface.

Sub Tank

A configuration of the sub tank will be described below. The first sub tank 142*a* and the second sub tank 142*b* have the same configuration. In the following, the configuration of a single sub tank will be described.

FIGS. 3A and 3B are diagrams illustrating an example of the single sub tank. FIG. 3A is a side view of the sub tank, and FIG. 3B is a partial cross-sectional view for explaining an internal configuration of the sub tank. In FIGS. 3A and 3B, some of components are omitted for simplicity of explanation. The omitted components will be appropriately explained with reference to FIG. 2.

In the sub tank 142 illustrated in FIG. 3A and FIG. 3B, a structure of a container for containing ink liquid is formed at a side of a main body 80, and an opening is sealed by the flexible film (for example, a flexibly film member 82) by bonding or welding, so that an ink container 81 is constructed inside the sub tank 142. The ink container 81 illustrated in FIG. 3B has an approximately circular shape similar to an outer shape of the film member 82 when viewed from a front side illustrated in FIG. 3A.

An elastic member (for example, a spring or the like) 83 that biases the film member 82 outward is arranged between the main body 80 and the film member 82, i.e., inside the ink container 81. Here, the film member 82, the elastic member 83, and an air open valve mechanism 132 to be described later correspond to a "negative pressure generating means". The principle of generation of negative pressure by the "negative pressure generating means" will be described later.

An ink supply port 84 is arranged in a lower part of the main body 80. A removable connection part is connected to the ink supply port 84, so that ink liquid that has been transmitted by pressure from the main tank to the connection part is transmitted and supplied to the ink container 81. A liquid transmission pump (liquid transmitting unit) that transmits the ink liquid by pressure from the main tank to the sub tank 142 is constructed between the main tank and the sub tank 142. The ink liquid is fed to the ink supply port 84 from the main tank by the liquid transmission pump.

An ink outlet 85 is arranged in an upper part of the main body 80. The ink outlet 85 discharges the ink liquid to be supplied to the liquid discharge head 141 from the sub tank 142 with the aid of generated negative pressure. The ink outlet 85 and the supply port of the liquid discharge head 141 are connected by an ink tube or the like, so that the ink liquid discharged from the sub tank 142 is supplied to the liquid discharge head 141.

The air open valve mechanism 132 (see FIG. 2) as an air open means for switching between a sealed state and an air open state inside the sub tank 142 is arranged in an upper part of the main body 80. An air opening hole that communicates with the ink container 81 via an air flow path is opened and closed by the air open valve mechanism 132, so that the sealed state and the air open state inside the sub tank 142 are switched. By controlling open and close of the air open valve mechanism 132, the air opening hole is opened and closed.

Furthermore, a storage unit that stores therein ink liquid is arranged inside the main body 80. If an apparatus main body is inclined or oscillated, it is more likely that ink enters the air flow path. Therefore, the storage unit is provided so that ink that has entered from the air flow path can be stored in the storage unit. With this configuration, it is possible to prevent ink from entering the air opening hole and the air open valve mechanism 132, and prevent the entered ink from being solidified and causing operation failure.

Moreover, two detection electrodes 91 and 92 (see FIG. 2) for detecting that an amount of ink in the sub tank 142 reaches a predetermined amount or below (this state will be referred to as a "no-ink state") is attached in the upper part of the main body 80. It is possible to determine the no-ink state by detecting a state in which both of the detection electrodes 91 and 92 are immersed in ink and a state in which at least one of the detection electrodes 91 and 92 is not immersed in ink on the basis of a change of a conduction state between the detection electrodes 91 and 92.

Ink Liquid Replenishing Process

An ink liquid replenishing process in the sub tank 142 will be described. For example, an ink supply process may be started when it is detected that the amount of ink in the sub tank 142 is equal to or smaller than a lower limit threshold, and the ink supply process may be stopped when it is detected that the amount of ink in the sub tank 142 is equal to or larger than an upper limit threshold.

First, the air open valve mechanism 132 of the sub tank 142 is opened to achieve the air open state inside the sub tank 142. Then, ink is transmitted and supplied from the main tank to the sub tank 142 by the liquid transmission pump. In this case, air inside the sub tank 142 is discharged to the outside through the air opening hole. A biasing force of the elastic member 83 is applied to the film member 82, so that negative pressure is generated inside the sub tank 142.

In this manner, it is possible to generate negative pressure inside the sub tank 142 by the film member 82 and the elastic member 83, so that the negative pressure generation mechanism can be simplified.

Sub Tank Mounting Position

FIG. 4 is a diagram for explaining mounting positions of the sub tanks 142 in the liquid discharge modules 14. FIG. 4 is a schematic diagram of the conveying drum 12 and a module structure of each of the liquid discharge modules 14 viewed from the same direction as in the view illustrated in FIG. 1, for easy understanding of the mounting positions of the sub tanks 142. In FIG. 4, side surfaces (flexible film sides) of the sub tanks 142 are attached so as to face a front side of the sheet surface. Therefore, the sub tanks 142 are represented by circles because the ink containers 81 have approximately circular shapes. The elastic members 83 that generate negative pressure are arranged in central parts of the sub tanks 142. Here, the central parts of the circles where the negative pressure is generated in the sub tanks 142 will be referred to as "negative pressure generation positions". On a discharge surface 1400 of each of the liquid discharge heads 141, the nozzle array is formed in the same direction as the side surface of the sub tank 142.

As illustrated in FIG. 4, each of the liquid discharge modules 14 is arranged on the image forming unit 10 in the apparatus at a different inclination along the conveying surface such that the discharge surface 1400 of the liquid discharge head 141 faces the outer periphery of the conveying drum 12. The liquid discharge head 141 is attached with predetermined arrangement on each of the liquid discharge modules 14. As one example, as illustrated in FIG. 4, each of the liquid discharge modules 14 is mounted at a different angle such that a perpendicular line of the discharge surface 1400 crosses a rotation axis of the conveying drum 12 at a right angle when the liquid discharge head 141 is attached. The holding member 143 of each of the liquid discharge modules 14 holds the containing member 142 such that a distance between the discharge surface 1400 of the liquid discharge head 141 and the containing member 142 in a direction of a perpendicular line of the discharge surface 1400 (indicated by a chain line in the figure) is larger as an angle between the perpendicular line and a horizontal plane 600 on which the image forming apparatus 1 is arranged is smaller. Meanwhile, it is preferable that the perpendicular line that extends from the discharge surface 1400 and crosses the rotation axis of the conveying drum 12 at a right angle is located on the nozzle array if the nozzle array is a single line in a region where the nozzles are formed (nozzle formation region) on the discharge surface 1400, for example. Furthermore, if a plurality of nozzle arrays are arranged parallel to one another, it is preferable to arrange the perpendicular line at a position (on a center line) at an equal distance from each of nozzle arrays located at both ends among the nozzle arrays (that is, two nozzle arrays located on the outermost side), for example.

Moreover, FIG. 4 illustrates an example in which the mounting positions of the sub tanks 142 are adjusted when the liquid discharge modules 14 are arranged at different inclinations. The mounting position of the sub tank 142 in each of the liquid discharge modules 14 is adjusted such that the positions of the sub tanks 142 relative to the respective liquid discharge heads 141 in a vertical direction become approximately the same or equivalent among the liquid discharge modules 14. Here, the vertical direction is a direction perpendicular to the horizontal plane 600 on which the image forming apparatus 1 is arranged. Specifically, in each of the liquid discharge modules 14, the position of the sub tank 142 in the vertical direction is adjusted such that a hydraulic head difference that is a difference between the position of the nozzle array of each of the liquid discharge heads 141 and the negative pressure generation position of the sub tank 142 in a height direction (vertical direction) become approximately the same or equivalent among the liquid discharge modules 14.

For example, as illustrated in FIG. 4, it is assumed that nozzle arrays 17A and 17B are arranged on the discharge surfaces 1400 of the liquid discharge heads 141 of two liquid discharge modules 14A and 14B. In this case, in each of the liquid discharge modules 14A and 14B, a distance at which the sub tank 142 is mounted along the perpendicular line of the discharge surface 1400 is changed on the basis of a position of each of the nozzle arrays 17A and 17B. In other words, by individually adjusting the distance at which the sub tank 142 is mounted in the direction of the perpendicular line of each of the discharge surfaces 1400, the position of the sub tank 142 in the vertical direction is adjusted such that hydraulic head differences in the respective liquid discharge modules 14 become approximately the same or equivalent between the liquid discharge modules 14.

In this manner, the positions of the sub tanks 142 in the vertical direction are adjusted such that the hydraulic head differences become equivalent among the liquid discharge modules 14. In each of the liquid discharge modules 14, if the sub tank 142 is mounted at the same distance in the direction of the perpendicular line of the discharge surface of the liquid discharge head 141, the hydraulic head differences vary among the liquid discharge modules 14 because the liquid discharge modules 14 are arranged at different inclinations. However, if the sub tanks 142 are adjusted with respect to the discharge surfaces in the direction of the perpendicular line, it is possible to set a height between each of the nozzle arrays and each of the negative pressure generation positions in the height direction to be approximately the same or a constant value L, so that it is possible to prevent variation in the hydraulic head difference among the liquid discharge modules 14.

The holding member 143 (see FIG. 2) is a member that holds the sub tank 142 and fixes the sub tank 142 at a predetermined position, and a member that adjusts the position at which the sub tank 142 is held (holding position) with respect to the discharge surface in the direction of the perpendicular line. The sub tank 142 is detachably attached to the holding member 143. The position for holding the sub tank 142 is adjusted by using, as the holding member 143, a component that is extendable and retractable in the height direction. With this configuration, it becomes possible to adjust the distance of the sub tank 142 relative to the discharge surface 1400 in the direction of the perpendicular line, so that it becomes possible to adjust the sub tank 142 in the height direction (vertical direction) in the image forming unit 10.

Meanwhile, the liquid discharge module 14 including the holding member 143 (see FIG. 2) may be provided by being attached to the image forming unit 10 in advance, or a user or a maintenance operator may later select and attach the holding member 143 to a mounting position in the image forming unit 10.

Further, an extendable/retractable direction indicates a direction in which the liquid discharge module 14 is separated away from (or comes close to) the outer periphery of the conveying drum 12 when the discharge surface 1400 of the liquid discharge head 141 is arranged so as to face the outer periphery of the conveying drum 12. For example, mounting portions are arranged as a first adjustment portion such that the sub tank 142 can be mounted by being moved to several positions in the vertical direction with respect to the discharge surface. In this case, the sub tank 142 can be moved to and mounted at a plurality of positions by the single holding member 143.

Furthermore, it may be possible to arrange a means that rotates the sub tank 142 in a circumferential direction about the negative pressure generation position. For example, structures (for example, structures for performing fastening with screws) that determine positions while changing orientation in the circumferential direction are arranged at a plurality of positions. In this case, it becomes possible to always locate the ink outlet 85 in an upper part regardless of the inclination of the liquid discharge module 14. With this configuration, it becomes easy to discharge air bubbles in an ink supply path extending to the sub tank 142, without leaving air bubbles inside the sub tank 142.

As described above, according to the first embodiment, it is possible to adjust the positions of the containing members in the vertical direction in the plurality of liquid discharge modules, and it is possible to prevent variation of discharging among the heads with a simple structure. For example, if a position at which a droplet is discharged onto a recording sheet is located on a curved surface, such as a conveying drum, the liquid discharge module is arranged so as to be inclined and face the curved surface for, for example, each of colors of ink liquid in accordance with the shape of the curved surface. Even in this case, it is possible to adjust the heights of the sub tanks by using the holding members such that the hydraulic head differences among head arrays at different inclinations become equivalent. Therefore, it is possible to prevent variation in quality of images that are formed in accordance with the positions of the head arrays used to form the images.

Liquid Discharge Module of Second Embodiment

As a liquid discharge module according to a second embodiment, a configuration of a liquid discharge module that is an inkjet head assembly will be described below. The liquid discharge module according to the second embodiment includes a liquid discharge head, a containing member that contains ink liquid to be supplied to the liquid discharge head, and a base bracket and an adjustment bracket that are one example of the holding member 143. The liquid discharge module as the head assembly is able to mount a large number of liquid discharge heads and supply liquid from a single sub tank to, for example, liquid discharge heads arranged in the same line in accordance with a combination of the liquid discharge heads, which is different from the liquid discharge module described in the first embodiment. The liquid discharge module as the head assembly is arranged on the image forming unit 10 at a different inclination such that a discharge surface of each of the liquid discharge heads faces the outer periphery of the conveying drum 12, similarly to the liquid discharge module illustrated in the first embodiment.

Figure 5A:
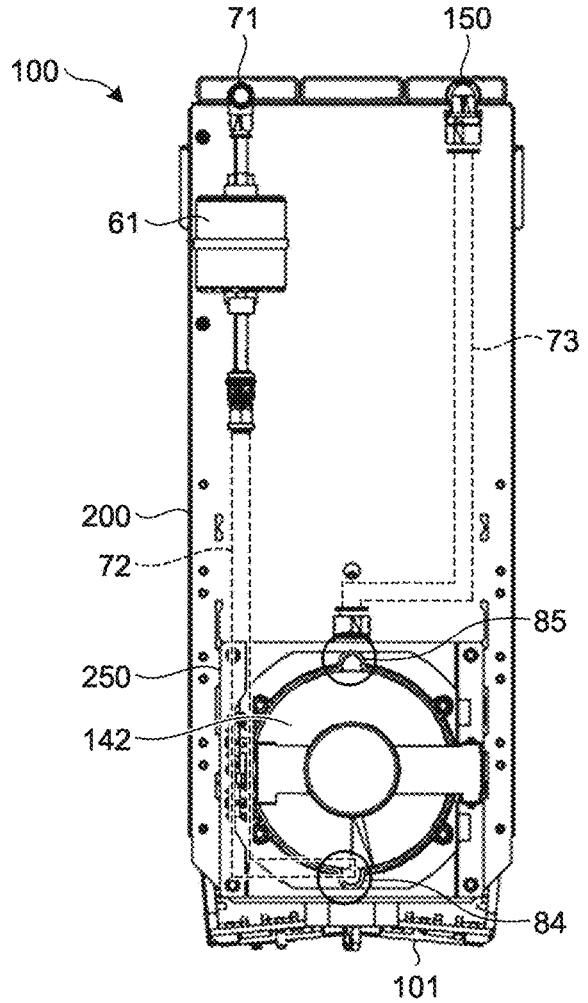
FIGS. 5A and 5B are diagrams illustrating an example of a configuration of a liquid discharge module according to a second embodiment.
Figure 5B:
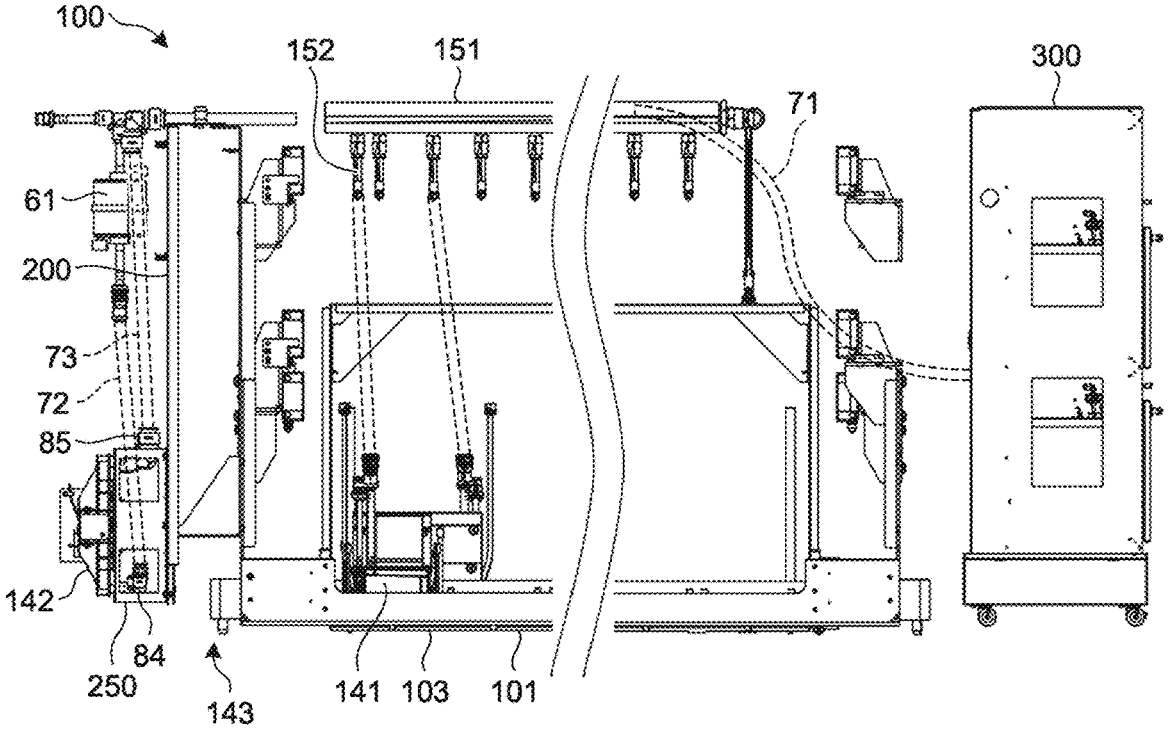

FIGS. 5A and 5B are diagrams illustrating an example of a configuration of the liquid discharge module as the head assembly, as the liquid discharge module according to the second embodiment. FIG. 5A illustrates a configuration of an attachment state (attachment state on the front surface side) in which the liquid discharge module is attached to the image forming apparatus 1 illustrated in FIG. 1 (assumed as a front surface). FIG. 5B illustrates a configuration of a side surface of the liquid discharge module and a main tank that supplies ink liquid to a sub tank of the liquid discharge module. Meanwhile, FIGS. 5A and 5B illustrate a configuration of the single liquid discharge module. An entire configuration will be schematically described below, and details of each of units of the liquid discharge module will be described later with reference to detailed figures.

A liquid discharge module 100 as the head assembly is able to mount and use a large amount of liquid discharge heads on a head attachment plate (head frame) 101 illustrated in a lower part of a main body. An ink manifold 150 is constructed in an upper part of the main body, and it is possible to distribute ink liquid from an ink common path 151 of the ink manifold 150 to each of the liquid discharge heads 141 through a branch path 152 that extends to each of the liquid discharge heads 141 that are attached at respective attachment positions 103. Here, the ink manifold 150 corresponds to a "liquid supply path".

An external bracket (base bracket) 200 and an adjustment bracket 250 for attaching the sub tank 142 to the main body are mounted on a plate on the front surface side of the liquid discharge module 100, and the sub tank 142 is attached by the brackets. Here, the base bracket 200 corresponds to a "first holding member", and the adjustment bracket 250 corresponds to a "second holding member". The holding member 143 including the bracket (base bracket) 200 and the adjustment bracket 250 holds the liquid discharge head 141 and the sub tank 142.

The ink liquid is transmitted to each of the units through pipes as illustrated in FIG. 5A and FIG. 5B. The ink liquid is transmitted from a main tank 300 to an ink filter 61 through a supply tube (ink tube or the like) 71, and the ink liquid that has passed through the ink filter 61 is transmitted to the ink supply port 84 located in the lower part of the sub tank 142 through a supply pipe 72, so that the ink container 81 is replenished with the ink liquid. The ink liquid in the sub tank 142 is transmitted from the ink outlet 85 located in the upper part of the sub tank 142 to the ink common path 151 of the ink manifold 150 through a pipe 73, and supplied from the branch path 152 to each of the liquid discharge heads 141.

Figure 6:
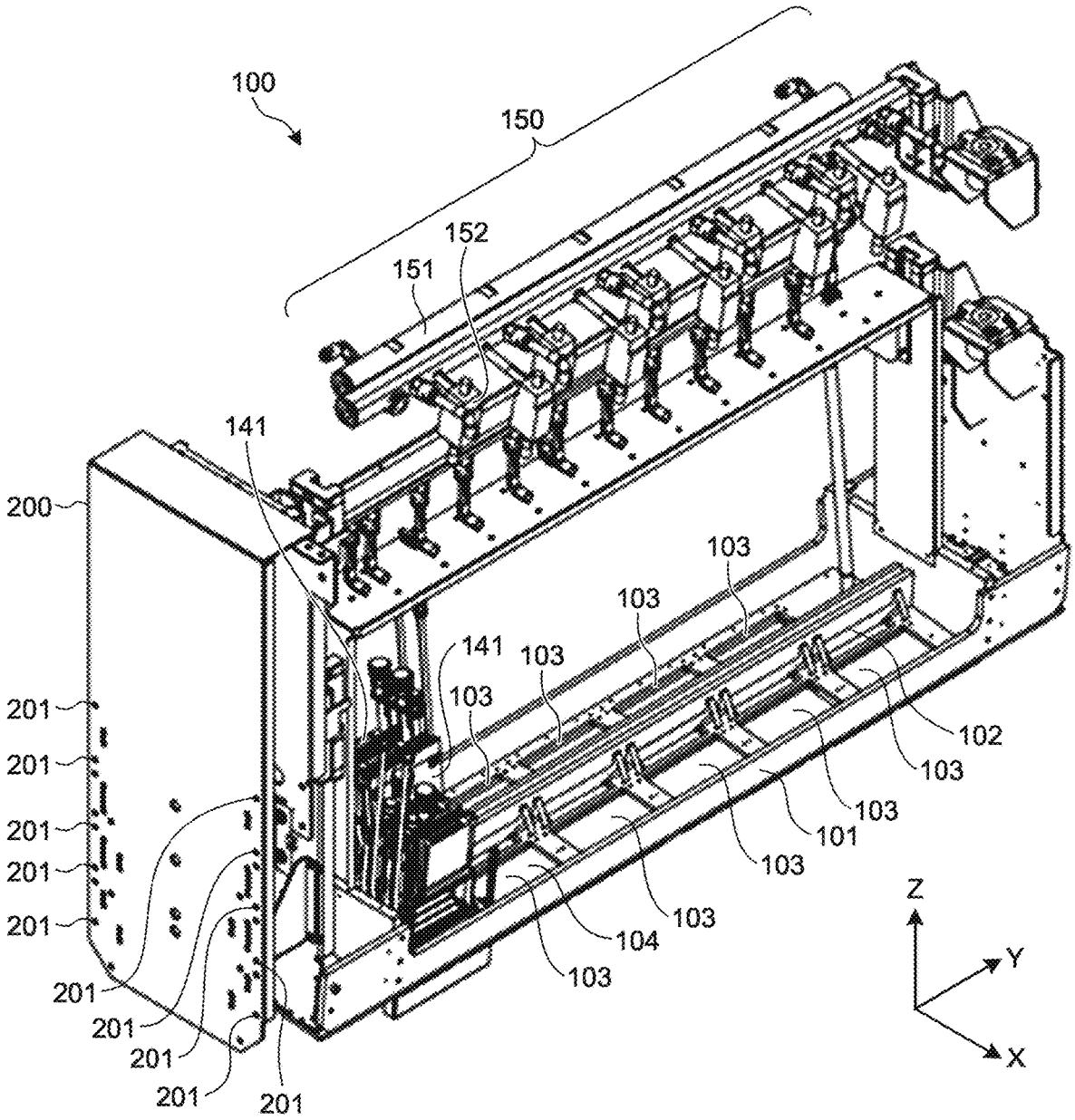
FIG. 6 is a diagram illustrating a state in which an external bracket (base bracket) is mounted on the liquid discharge module.
Figure 7:
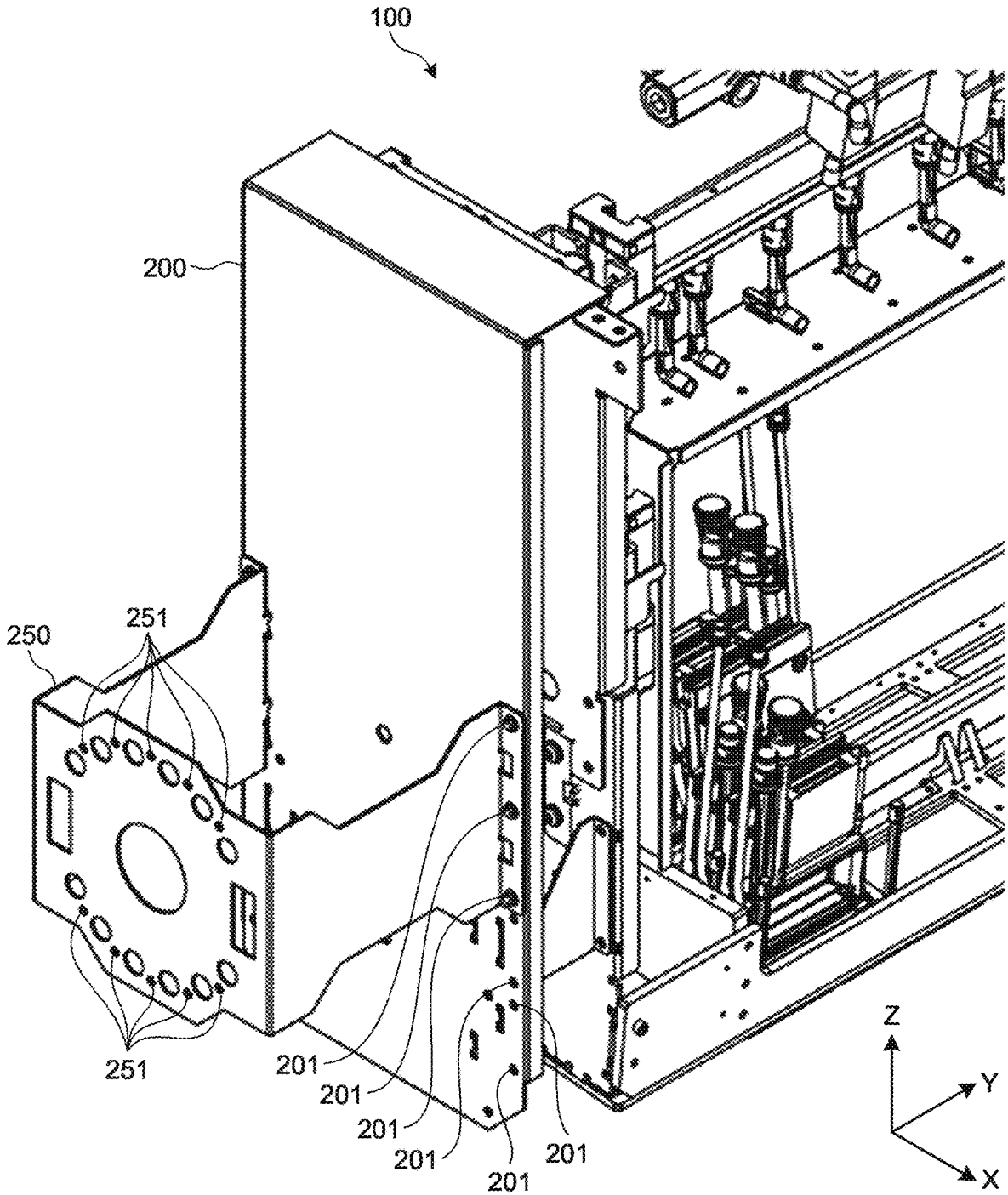
FIG. 7 is a diagram illustrating a state in which an adjustment bracket is mounted on the base bracket.

FIG. 6 and FIG. 7 are external perspective views illustrating steps of attachment to a main body of the liquid discharge module 100. First, common components of the liquid discharge module 100 illustrated in FIG. 6 and FIG. 7 will be described with reference to FIG. 6.

The liquid discharge module 100 illustrated in FIG. 6 is able to mount the 24 liquid discharge heads 141. The head attachment plate 101 illustrated in a lower part of the main body of the liquid discharge module 100 is formed so as to be able to mount six liquid discharge heads in the Y direction illustrated in FIG. 6 and mount a total of four arrays such that two arrays are arranged on each side across a structure 102 that extends in the Y direction. The liquid discharge heads are attached such that the discharge surfaces face the negative Z direction (downward in this arrangement), and the discharge surfaces are exposed in the negative Z direction from an opening 104 of the head attachment plate 101. FIG. 6 illustrates a state in which, as one example, the two liquid discharge heads 141 are attached. Among first to sixth attachment positions in each of the two arrays on one side, the liquid discharge head 141 is attached to the first attachment position 103 in each array. The attachment states at the other attachment positions 103 are not illustrated, but the liquid discharge head 141 is attached and used at each of the other attachment positions 103.

The ink manifold 150 is constructed in the upper part of the main body. The ink manifold 150 distributes the ink liquid to each of the liquid discharge heads 141 from the ink common path 151 of the ink liquid through the branch path 152 extending to each of the liquid discharge heads 141 that are attached to the respective attachment positions 103.

FIG. 6 further illustrates a state in which the external bracket (base bracket) 200 that can adjust the position and the posture of the sub tank 142 (see FIGS. 5A and 5B) is mounted on the liquid discharge module 100. Further, FIG. 7 illustrates a state in which the adjustment bracket 250 that adjusts the position and the posture of the sub tank 142 is further mounted on the base bracket 200 illustrated in FIG. 6. When the sub tank 142 is to be attached, the position and the posture of the sub tank 142 are adjusted by using the adjustment bracket 250. Here, as one example, a use example will be described in which adjustment in the vertical direction (the Z direction in FIG. 7) and rotation adjustment in a positive direction or a negative direction about the negative pressure generation position serving as a central axis are performed. Meanwhile, the vertical direction described in this example is a direction in which "upward" indicates a direction away from the outer periphery of the conveying drum 12 and "downward" indicates a direction approaching the outer periphery of the conveying drum 12 when the liquid discharge module 100 is arranged such that the discharge surface 1400 of the liquid discharge head 141 faces the outer periphery of the conveying drum 12. Furthermore, the central axis described above is an axis that is perpendicular to a conveying direction of a discharge target and a liquid discharge direction when the liquid discharge module 100 is arranged such that the discharge surface 1400 of the liquid discharge head 141 faces the outer periphery of the conveying drum 12.

How to Use Brackets

Configurations of the base bracket 200 and the adjustment bracket 250 will be first described, and thereafter, how to use the brackets will be described using an example. As illustrated in FIG. 6, the base bracket 200 is a plate member that extends in the upward direction (Z direction), i.e., the direction away from the outer periphery of the conveying drum 12, and includes a plurality of screw holes 201 in accordance with a plurality of mounting positions in the vertical direction such that the mounting position of the adjustment bracket 250 illustrated in FIG. 7 can be adjusted in the vertical direction (Z direction). By mounting the adjustment bracket 250 by using the different screw holes 201 that are arranged in the direction away from the outer periphery, it is possible to adjust the holding position of the sub tank 142 in the direction away from the outer periphery of the conveying drum 12. Furthermore, the adjustment bracket 250 illustrated in FIG. 7 includes a plurality of holes 251 along a rotation direction (circumferential direction) of the sub tank 142 such that the sub tank 142 can be held by being rotated in a positive circumferential direction or a negative circumferential direction about the negative pressure generation position serving as the central axis.

Here, the plurality of screw holes 201 of the base bracket 200 are one example of a "first adjuster", a "first mounting part", and the like. Further, the plurality of holes 251 of the adjustment bracket 250 are one example of a "second adjuster", a "second mounting part", and the like. Meanwhile, the "first adjuster", the "first mounting part", the "second adjuster", and the "second mounting part" are not limited thereto, and other modes may be adopted.

When the sub tank 142 is to be attached to the liquid discharge module 100, the base bracket 200 is mounted on the liquid discharge module 100 with screws or the like, and the adjustment bracket 250 is mounted at an adjusted height on the base bracket 200 with screws. The sub tank 142 is held by being fastened to the adjustment bracket 250 with screws via the holes 251. In this manner, the sub tank 142 can be detachably attached by detaching and attaching screws from and to the base bracket 200. Meanwhile, the base bracket 200 may be mounted on the liquid discharge module 100 in advance, or may be integrally configured as a part of the main body of the liquid discharge module 100.

Figure 8:
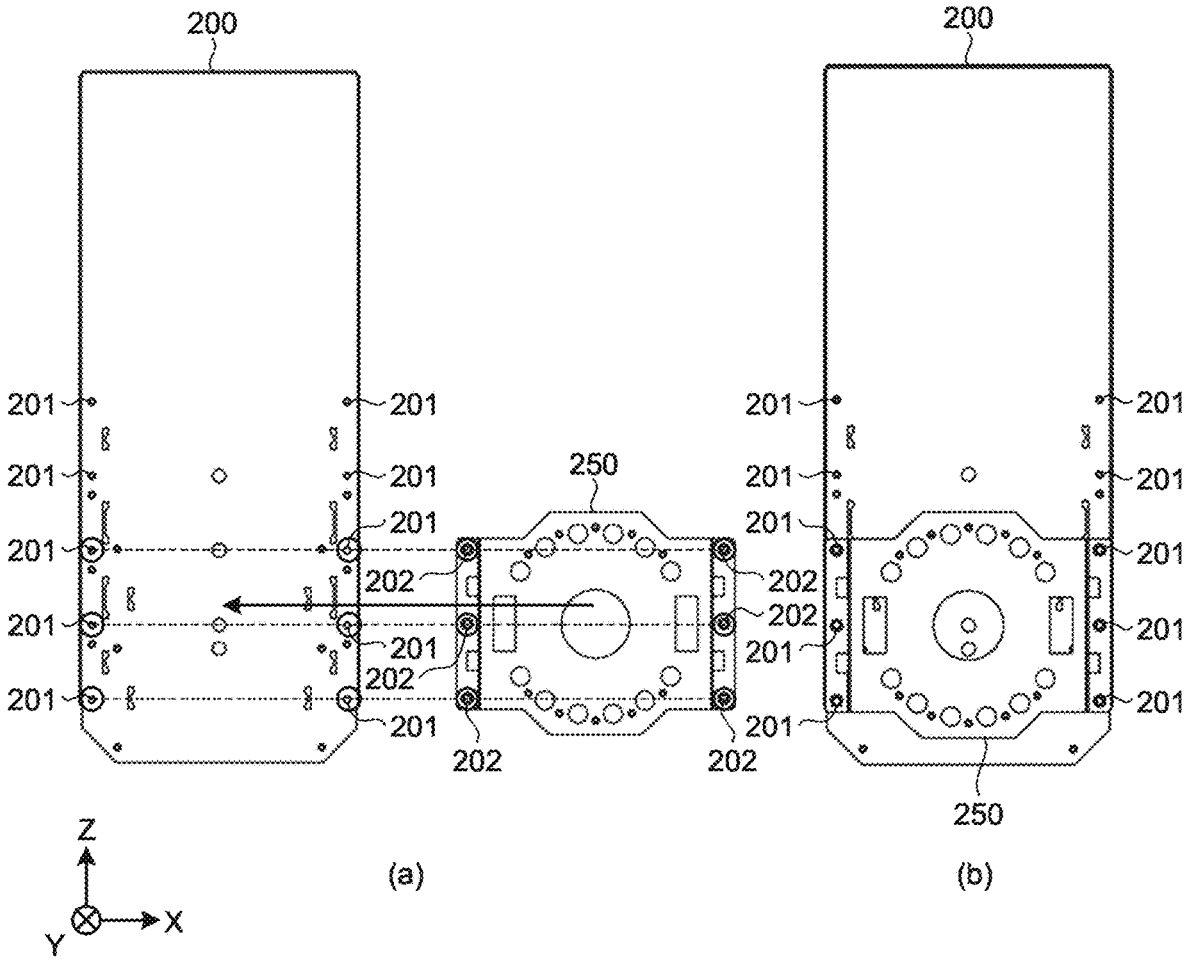
FIG. 8 is a diagram illustrating an example of a mounting position in a case where the sub tank is mounted at an adjusted height.
Figure 9:
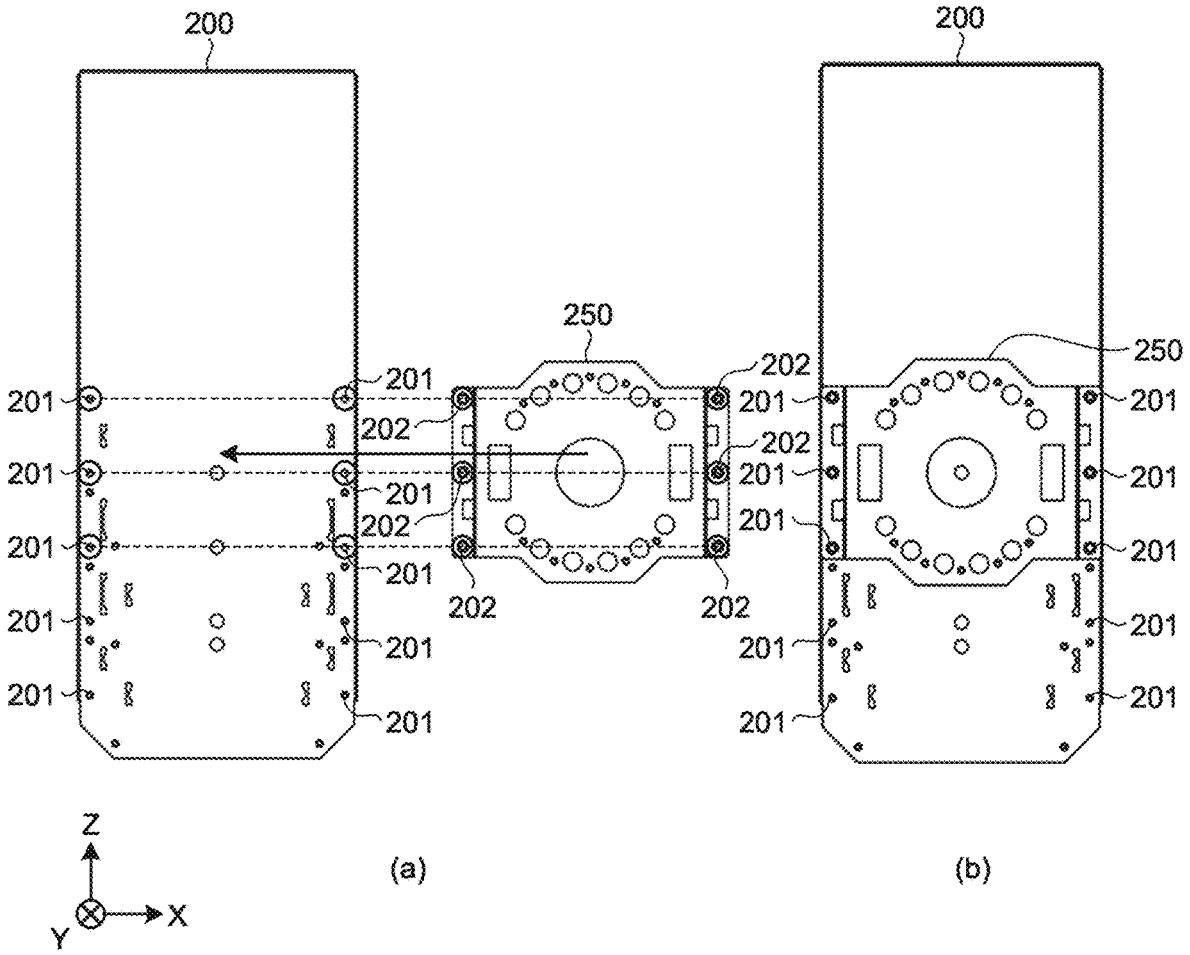
FIG. 9 is a diagram illustrating another example of the mounting position in a case where the sub tank is mounted at an adjusted height.

FIG. 8 and FIG. 9 are diagrams illustrating an example of the mounting position in a case where the sub tank 142 is mounted at an adjusted height. FIG. 8 illustrates, at (a), a corresponding relationship between the mounting positions of the base bracket 200 and the adjustment bracket 250 when the sub tank 142 is mounted at a low position. FIG. 8 illustrates, at (b), a result in a case where mounting is performed based on the positional relationship as illustrated at (a) in FIG. 8. FIG. 9 illustrates, at(a), a correspondence relationship between the mounting positions of the base bracket 200 and the adjustment bracket 250 in a case where the sub tank 142 is mounted at a high position. FIG. 9 illustrates, at (b), a result in a case where mounting is performed based on the positional relationship as illustrated at (a) in FIG. 9.

As illustrated at (a) in FIG. 8 (or (a) in FIG. 9), the base bracket 200 includes the screw holes 201 in accordance with a plurality of positions for three-level height adjustment so that the height can be adjusted at three levels. As illustrated in FIG. 8 (or FIG. 9), the holes 202 that are arranged at six positions in the adjustment bracket 250 are aligned with the six screw holes 201 at a height at which the base bracket 200 is to be mounted, and the adjustment bracket 250 is fastened to the base bracket 200 with screws at this position. The sub tank 142 is fastened at the position of the predetermined holes 251 of the adjustment bracket 250 with screws before the adjustment bracket 250 is fastened to the base bracket 200 with screws.

Figure 10:
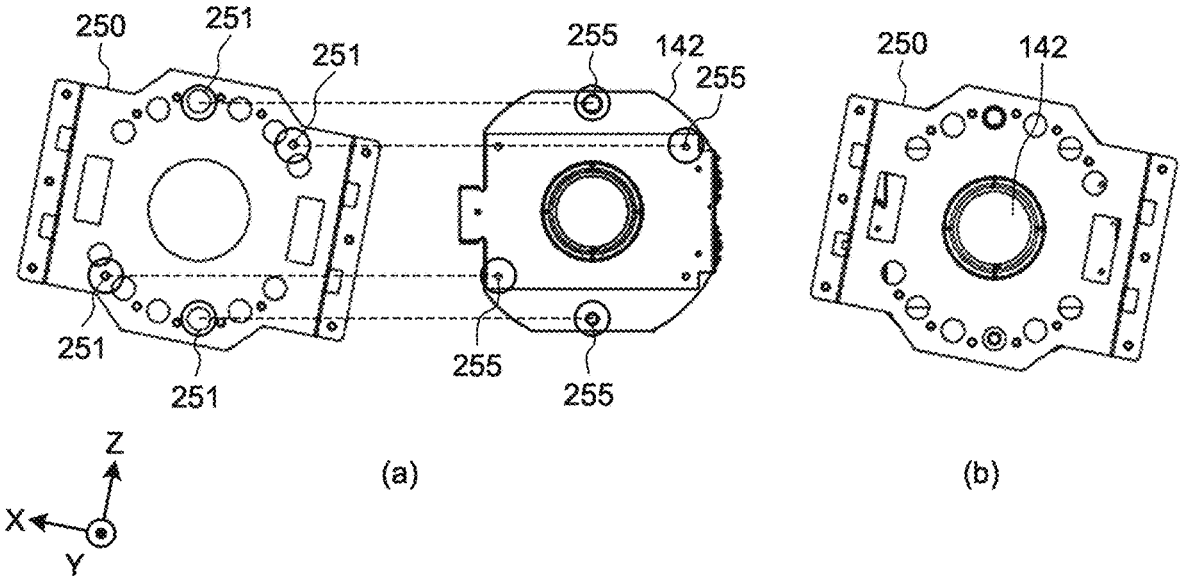
FIG. 10 is a diagram illustrating an example of a mounting position in a case where the sub tank is mounted with adjustment in a rotation direction.
Figure 11:
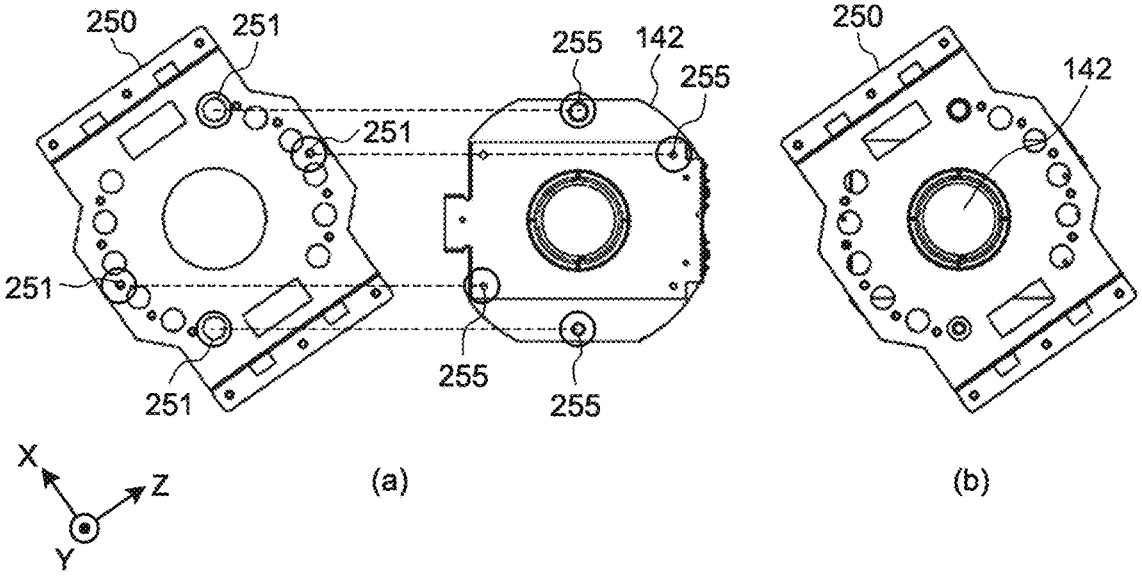
FIG. 11 is a diagram illustrating another example of the mounting position in a case where the sub tank is mounted with adjustment in the rotation direction.

FIG. 10 and FIG. 11 are diagrams illustrating an example of the mounting positions in a case where the sub tank 142 is mounted while being adjusted in the rotation direction. FIG. 10 illustrates, at (a), a correspondence relationship of the mounting positions in a case where the sub tank 142 is mounted on the base bracket 200 at a small rotation angle. FIG. 10 illustrates, at (b), a result in a case where mounting is performed based on the positional relationship as illustrated at (a) in FIG. 10. FIG. 11 illustrates, at (a), a correspondence relationship of the mounting positions in a case where the sub tank 142 is mounted on the base bracket 200 at a large rotation angle. FIG. 11 illustrates, at (b), a result in a case where mounting is performed based on the positional relationship as illustrated at (a) in FIG. 11. Meanwhile, FIG. 10 and FIG. 11 illustrate the cases in which the adjustment bracket 250 is inclined with respect to the sub tank 142. A direction in which the adjustment bracket 250 illustrated at (b) in FIG. 10 and (b) in FIG. 11 is adjusted in the vertical direction of the base bracket 200 is represented by the Z direction at (b) in FIG. 10 and (b) in FIG. 11.

As illustrated at (a) in FIG. 10 (or (a) in FIG. 11), the plurality of holes 251 are arranged on the adjustment bracket 250 along the rotation direction (circumferential direction) such that the sub tank 142 can be held by being rotated in the positive circumferential direction or the negative circumferential direction about the negative pressure generation position serving as the central axis. In the sub tank 142, four screw holes 255 are arranged such that the sub tank 142 can be fastened through the four holes 251 of the adjustment bracket 250 with screws. As illustrated in at (a) in FIG. 10 (or (a) in FIG. 11), the four screw holes 255 arranged in the sub tank 142 are aligned with the holes 251 at four positions corresponding to a mounting rotation angle among the plurality of holes 251 of the adjustment bracket 250, and the sub tank 142 is fastened to the adjustment bracket 250 at these positions with screws. With this fastening, the adjustment bracket 250 holding the sub tank 142 is mounted on the base bracket 200 at a certain height adjusted in the Z direction.

Figure 12:
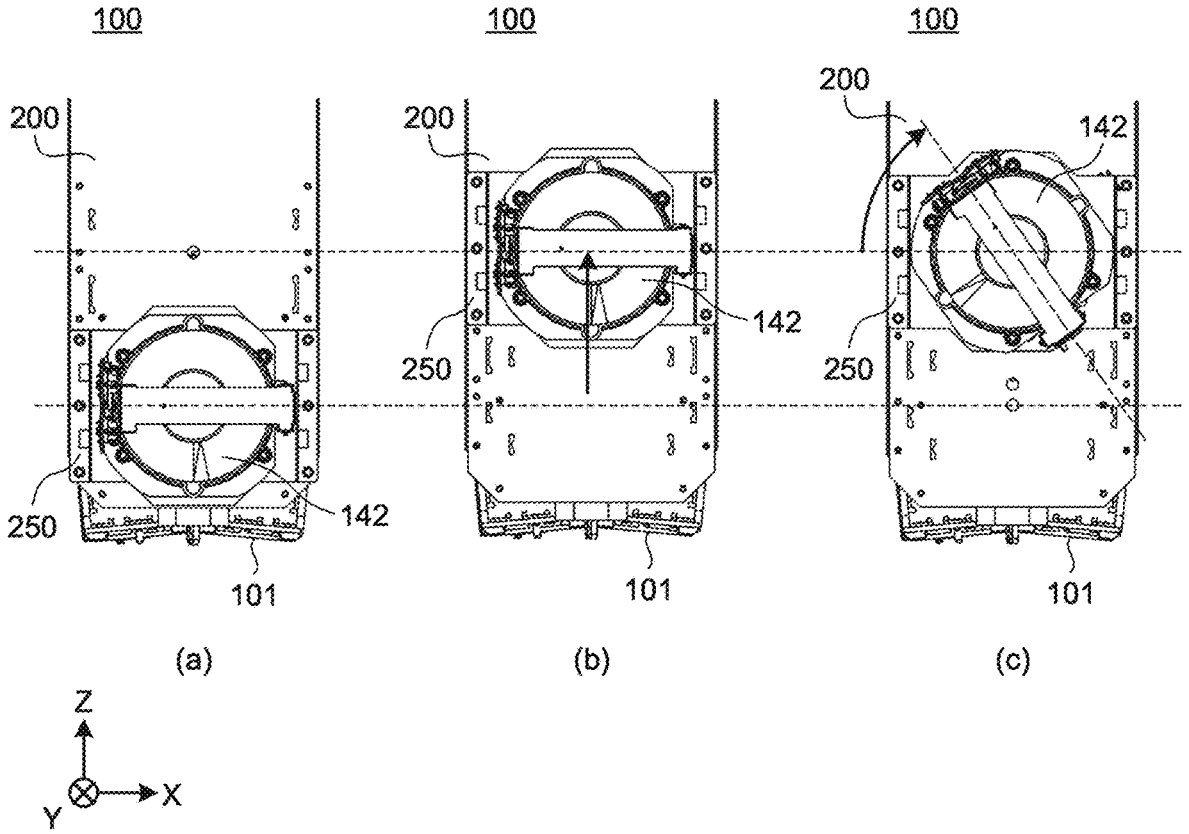
FIG. 12 is a diagram illustrating an example of an attachment state in which the sub tank is attached to the liquid discharge module by using the base bracket and the adjustment bracket.

FIG. 12 is a diagram illustrating an example of an attachment state in which the sub tank 142 is attached to the liquid discharge module 100 by using the base bracket 200 and the adjustment bracket 250. As one example, three attachment examples are illustrated at (a), (b), and (c) in FIG. 12. At (a), (b), and (c) in FIG. 12, dashed lines and arrows are illustrated to clarify a relative arrangement relationship.

FIG. 12 illustrates, at (a), an attachment example in which the sub tank 142 is attached at a low position in the liquid discharge module 100. FIG. 12 illustrates, at (b), an attachment example in which the sub tank 142 is attached to a high position in the liquid discharge module 100. The sub tank 142 is attached to the high position indicated in the arrow direction at (b) in FIG. 12, relative to the low position illustrated at (a) in FIG. 12. FIG. 12 illustrates, at (c), an attachment example in which the sub tank 142 is attached at a high position in the liquid discharge module 100 by being rotated by a predetermined rotation angle. As indicated by the arrow at (c) in FIG. 12, the sub tank 142 is attached by being rotated by a predetermined rotation angle from a horizontal line.

Figure 13:
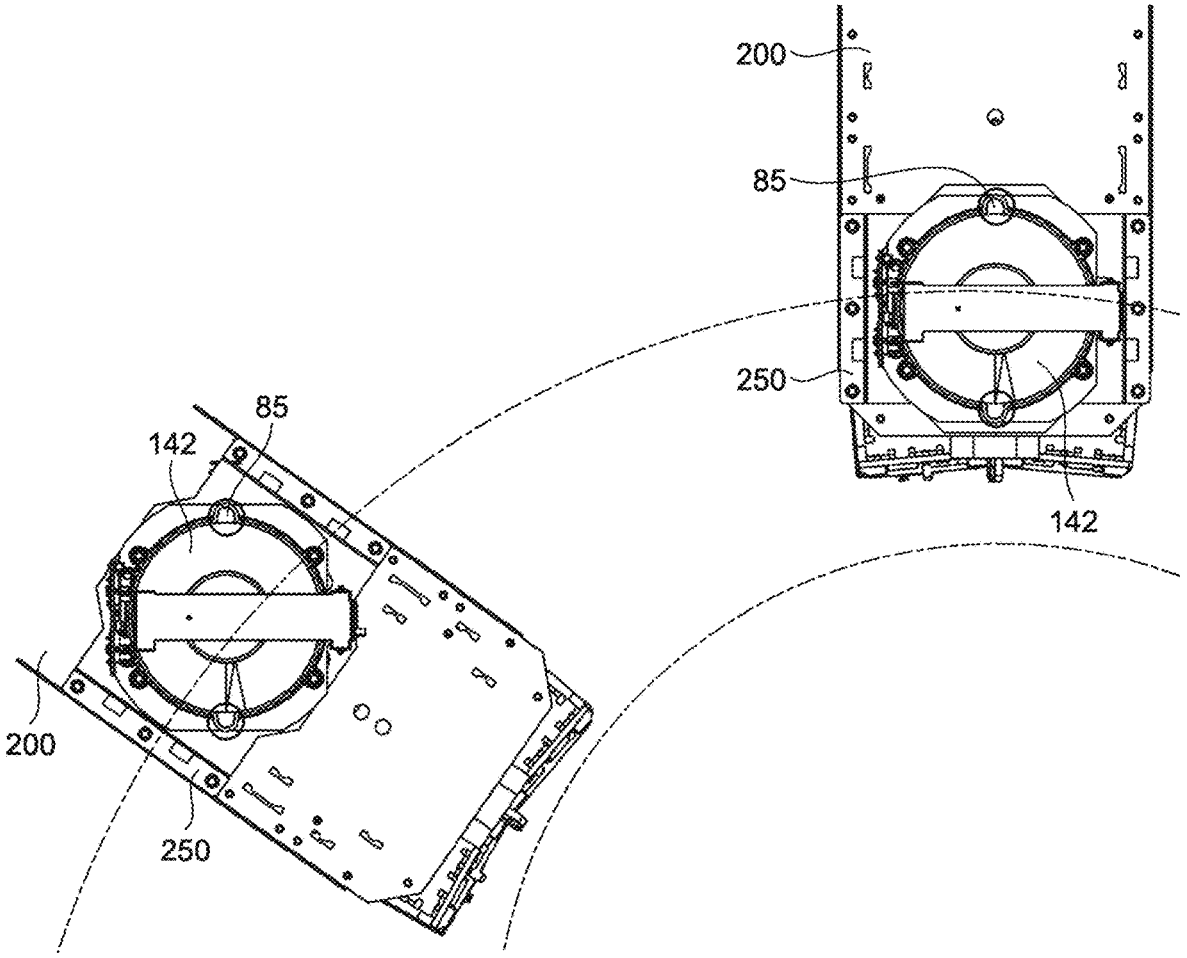
FIG. 13 is a diagram illustrating an example of setting of the sub tanks of the liquid discharge modules that are arranged at different angles along with an outer periphery of a conveying drum.

FIG. 13 is a diagram illustrating an example of setting of the sub tanks 142 of the liquid discharge modules 100 that are arranged at different angles along with the outer periphery of the conveying drum 12 (see FIG. 1). Each of the liquid discharge modules 100 is set in the image forming unit 10 at a different angle along with the outer periphery of the conveying drum 12. In other words, the set liquid discharge modules 100 are inclined differently. Therefore, if the positional relationship between the liquid discharge head 141 and the sub tank 142 in each of the liquid discharge modules 100 is the same, the hydraulic head difference varies. While the three attachment examples are illustrated at (a), (b), and (c) in FIG. 12, the sub tank 142 is set by appropriately adjusting the height and the rotation angle.

Specifically, as illustrated in FIG. 13, the sub tanks 142 are assembled at adjusted heights by using the base bracket 200 and the adjustment bracket 250 in accordance with the set positions of the liquid discharge modules 100, i.e., in accordance with the inclinations of the liquid discharge modules 100. Further, the sub tanks 142 are assembled at adjusted rotation angles such that the ink outlets 85 are always located in the upper parts as illustrated in FIG. 13 in accordance with the inclinations of the liquid discharge modules 100. In the setting of the sub tanks 142 illustrated in FIG. 13, the sub tank 142 is attached to a higher position in the liquid discharge module 100 located at a larger inclination so that the hydraulic head difference can always be set to the constant value L (see FIG. 4). Further, the sub tank 142 is attached at a larger rotation angle in the liquid discharge module 100 located at a larger inclination so that the ink outlet 85 can always be located in the upper part.

As described above, even in the second embodiment, it is possible to adjust the positions of the containing members in the vertical direction in the plurality of liquid discharge modules with a simple configuration, so that it is possible to prevent variation of discharging among the heads by a simple method.

Furthermore, like the base bracket 200, it is sufficient to adjust the holding position of the containing member in the direction away from the conveying surface by using the holding member that extends in the direction away from the conveying surface along which the discharge target for discharging liquid is conveyed; therefore, it is possible to easily perform adjustment operation.

Moreover, it is possible to simplify a structure for holding the containing member by providing the second adjuster that adjusts the position of the containing member in the rotation direction in the adjustment bracket 250.

Furthermore, like the combination of the base bracket 200 and the adjustment bracket 250, by allowing different mechanisms to adjust the position of the containing member in the vertical direction and the holding position in the rotation direction, it is possible to simplify the adjustment operation and simplify the structure.

Moreover, by arranging the plurality of screw holes 201 that are arranged in the direction away from the conveying surface as in the base bracket 200, it is possible to perform operation of adjusting the position of the containing member in the vertical direction in a visually easy manner.

Furthermore, by arranging the plurality of holes 251 that are arranged in the circumferential direction as in the adjustment bracket 250, it is possible to perform operation of adjusting the position of the containing member in rotation direction in a visually easy manner.

Moreover, by allowing the containing member to be detachably attached, it is possible to easily perform operation of exchanging the containing member.

Modification of Second Embodiment

As a modification of the second embodiment, a configuration of a liquid discharge module that discharges different kinds of ink liquid (for example, ink liquid of different colors) in a main body of a single liquid discharge module will be described. In the following, only components different from the configuration of the liquid discharge module of the second embodiment will be described.

Figure 14A:
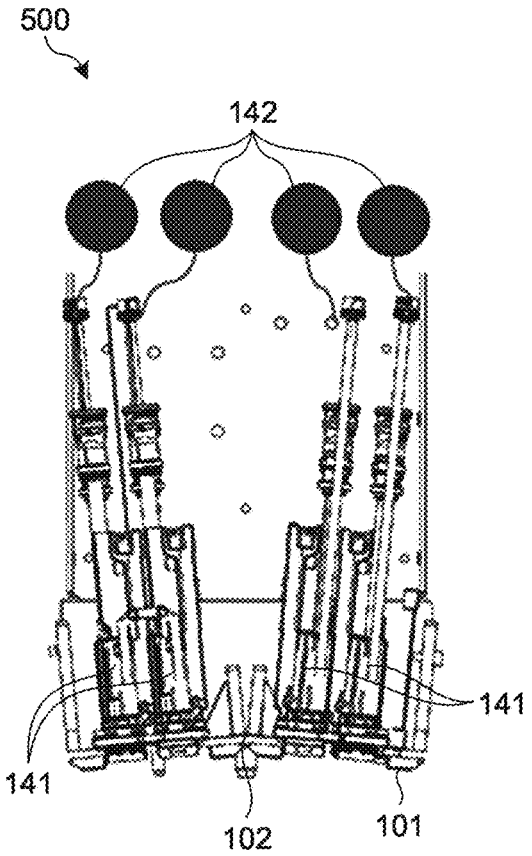
FIGS. 14A and 14B are diagrams illustrating an example of a configuration of a liquid discharge module according to a modification of the second embodiment.
Figure 14B:
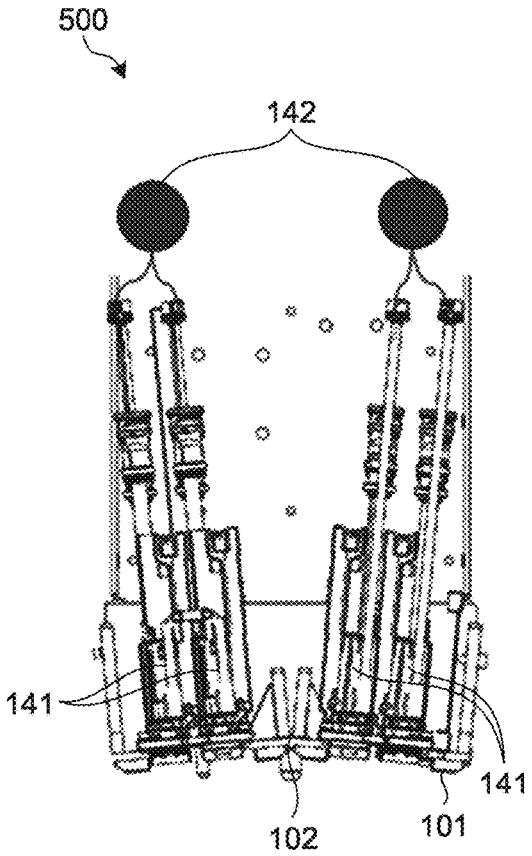

FIGS. 14A and 14B are diagrams illustrating an example of the configuration of the liquid discharge module according to the modification of the second embodiment. FIG. 14A and FIG. 14B illustrate liquid discharge modules 500 according to the modification, both of which have the same configuration. Here, for easy understanding of an outer shape and an internal configuration of the liquid discharge module 500 according to the modification, the liquid discharge heads 141 attached at different positions in a depth direction are viewed from a front side, i.e., viewed from the same front side as the attachment state of the liquid discharge module 500 in the image forming apparatus 1 (assumed as the front side) as illustrated in FIG. 1. A difference between FIG. 14A and FIG. 14B is the number of attached sub tanks. The sub tank 142 is schematically illustrated to clarify a connection relationship.

The liquid discharge module 500 of the modification as illustrated in FIG. 14A (the same applies to FIG. 14B) is configured to allow attachment to be performed in such a manner that the discharge surfaces 1400 are oriented differently between a set of two arrays (even) on one side and a set of two arrays (odd) on the other side across the structure 102 on the head attachment plate 101, as compared to the liquid discharge module 100 described in the second embodiment. Specifically, left and right sides of the head attachment plate 101 are inclined at different angles such that the discharge surfaces 1400 of the liquid discharge heads 141 face the outer periphery of the conveying drum 12 across the structure 102. As illustrated in FIG. 14A (the same applies to FIG. 14B), each of the liquid discharge heads 141 attached to the liquid discharge module 500 is oriented in a direction in which the discharge surface 1400 faces the outer periphery of the conveying drum 12 at each of the positions on the left and right sides across the structure 102.

FIG. 14A illustrates a connection example in which the sub tank 142 is attached to each array. In an upper part of a main body of the liquid discharge module 500, the ink manifold 150 (see FIG. 6) is constructed for each of the arrays of the liquid discharge heads 141, and the sub tank 142 for supplying ink liquid is individually attached to each of the ink common paths 151 (see FIG. 6). In other words, in the connection example in FIG. 14A, the four sub tanks 142 are attached. For example, four kinds of ink liquid (CMYK or the like) are assigned to and used in the respective arrays.

FIG. 14B illustrates a connection example in which the sub tank 142 is attached for each set of two arrays on each side. In the upper part of the main body of the liquid discharge module 500, the ink manifold 150 (see FIG. 6) is constructed for each of the arrays of the liquid discharge heads 141, the ink common paths 151 (see FIG. 6) are combined for each set of two arrays on each side, and the single sub tank 142 is attached to each set of two arrays. In other words, in the connection example in FIG. 14B, the two sub tanks 142 are attached. For example, two kinds of ink liquid (two colors or the like) are assigned to and used in the respective sets of two arrays.

FIG. 15A to FIG. 16B are diagrams illustrating an example of an attachment state in which the plurality of sub tanks 142 are attached to the main body of the single liquid discharge module 500. To attach the plurality of sub tanks 142 to the main body of the single liquid discharge module 500, it is sufficient to increase the adjustment brackets 250 in accordance with the number of the sub tanks 142 to be attached. Here, as one example, an example will be described in which the two sub tanks 142 are attached.

Figure 15A:
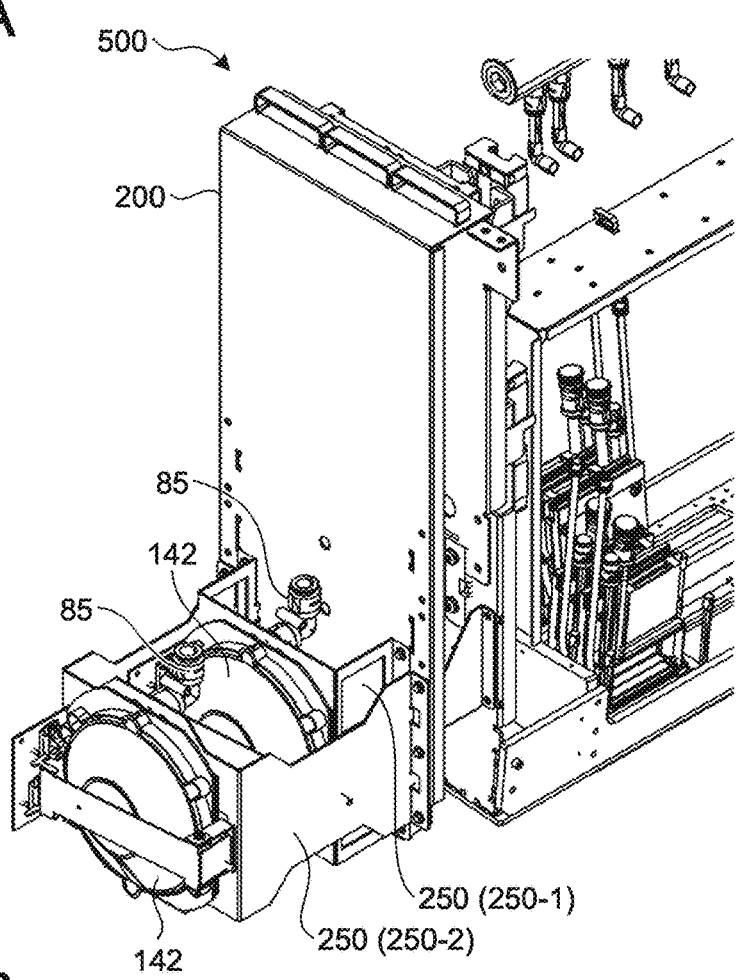
FIGS. 15A and 15B are diagrams illustrating an example of an attachment state in a case where a plurality of sub tanks are attached to a main body of a single liquid discharge module.
Figure 15B:
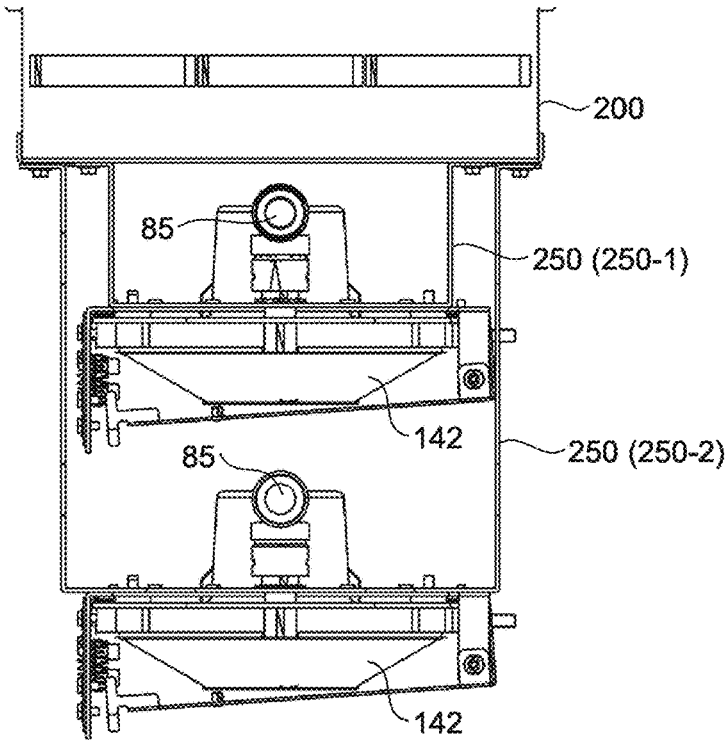

FIGS. 15A and 15B are diagrams illustrating an attachment state of the two sub tanks 142 at a position at which the main body of the liquid discharge module 500 is set in an erected manner, i.e., set without being inclined, in the image forming unit 10. FIG. 15A illustrates a perspective view of the attachment state of the two sub tanks 142, and FIG. 15B illustrates the attachment state of the two sub tanks 142 viewed from above (plan view).

As illustrated in FIG. 15A, the first sub tank 142 is attached to the main body of the liquid discharge module 500 by mounting the adjustment bracket 250 (250-1) on the base bracket 200 as has been described above. The second sub tank 142 is attached to the main body of the liquid discharge module 500 by further mounting the adjustment bracket 250 (250-2) on an outer side of the first sub tank 142 that has been mounted on the base bracket 200. Here, an example is described in which the adjustment bracket 250-2 that is slightly larger than the first adjustment bracket 250-1 is used. The second adjustment bracket 250-2 has the same function as the first adjustment bracket 250-1. In other words, the second adjustment bracket 250-2 can be mounted on the base bracket 200 by being moved in the vertical direction, and can be mounted on the base bracket 200 such that the sub tank 142 is inclined in the circumferential direction.

In the example illustrated in FIG. 15A and FIG. 15B, when the main body of the liquid discharge module 500 is erected, the hydraulic head difference can be set to the same between the set of two arrays on one side and the set of two arrays on the other side across the structure 102 by arranging the sub tanks 142 in the same orientation in the Z direction in both of the set of two arrays on one side and the set of two arrays on the other side across the structure 102 (see FIG. 14B).

Figure 16A:
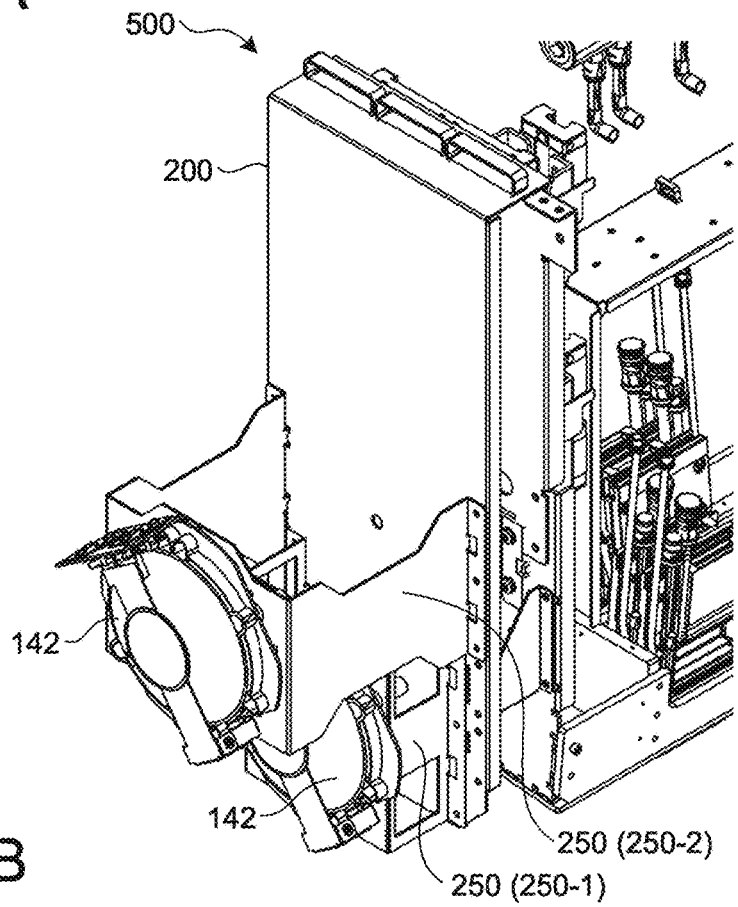
FIGS. 16A and 16B are diagrams illustrating an example of an attachment state in a case where a plurality of sub tanks are attached to the main body of the single liquid discharge module.
Figure 16B:
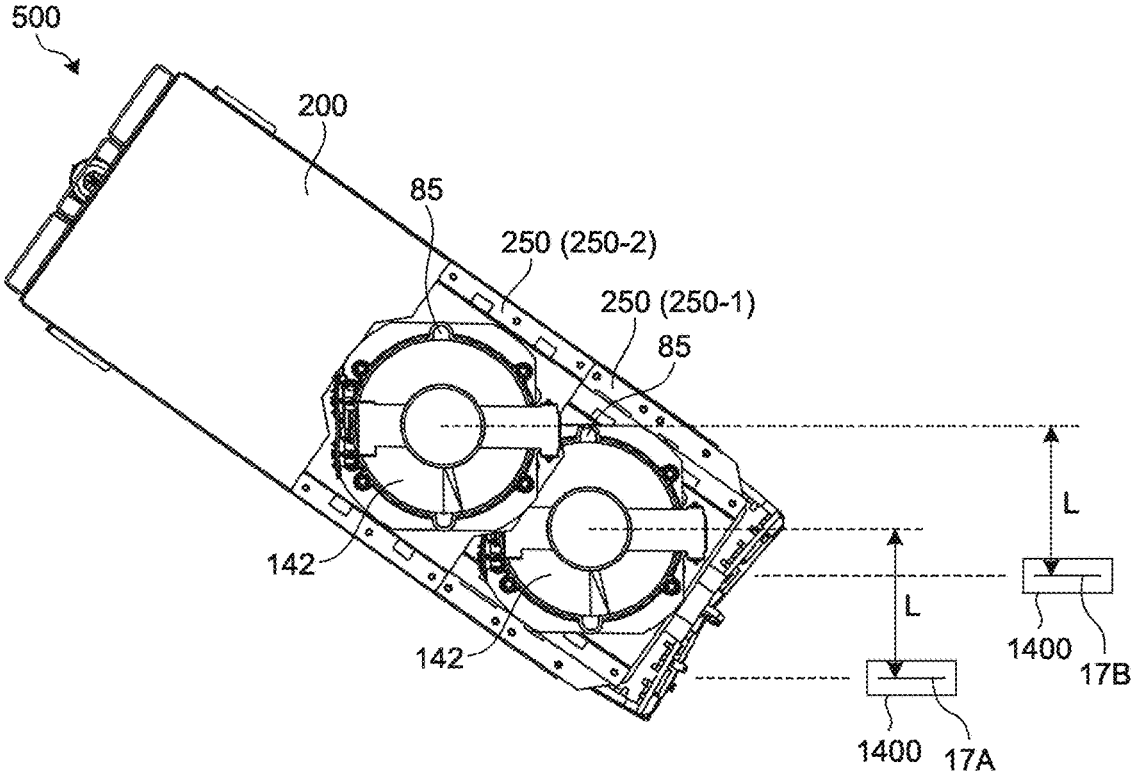

FIGS. 16A and 16B are diagrams illustrating an attachment state of the two sub tanks 142 at a position at which the main body of the liquid discharge module 500 is set in an inclined manner in the image forming unit 10. FIG. 16A illustrates a perspective view of the attachment state of the two sub tanks 142. FIG. 16B illustrates the hydraulic head difference at the position at which the main body of the liquid discharge module 500 is set in the inclined manner.

When the main body of the liquid discharge module 500 is set in an inclined manner, the hydraulic head difference varies between the set of two arrays on one side and the set of two arrays on the other side across the structure 102; therefore, it is necessary to displace mounting positions of the sub tanks 142 such that the hydraulic head difference in each of the sets of two arrays becomes equivalent at the value L that has been set in the other liquid discharge module 500. Therefore, as illustrated in FIG. 16A, the mounting positions on the base bracket 200 using the adjustment bracket 250-1 and the adjustment bracket 250-2 are displaced between the sub tank 142 that supplies ink liquid to the set of two arrays on one side and the mounting position of the sub tank 142 that supplies ink liquid to the set of two arrays on the other side. Furthermore, if the main body of the liquid discharge module 500 is set in an inclined manner, the orientation of the ink outlet 85 of the sub tank 142 is changed in accordance with the inclination. Therefore, each of the sub tanks 142 is mounted by being rotated by the same rotation amount in the circumferential direction about the negative pressure generation position serving as a center. With this configuration, the ink outlet 85 is located so as to always face upward.

In this manner, as illustrated in FIG. 16B, the hydraulic head difference is set to the constant value L in each of the set of two arrays in one side and the set of two arrays in the other side at a position at which the main body of the liquid discharge module 500 is set in an inclined manner. Meanwhile, FIG. 16B illustrates that the hydraulic head differences are set to the constant value L at a boundary line between the sets of two arrays on each side.

Here, as one example, the example has been described in which the two sub tanks 142 are attached such that one of the sub tanks 142 is shared with the two arrays on one side and the other one of the sub tanks 142 is shared with the two arrays on the other side across the structure 102 (see FIG. 14B). Meanwhile, if the sub tank 142 is attached for each of the arrays, i.e., if the four sub tanks are attached as illustrated in FIG. 14A, the sub tanks 142 are attached so as to be displaced from one another such that the hydraulic head difference in the nozzle formation region of the discharge surface 1400 of each of the arrays can be set to the constant value L. Even when the four sub tanks 142 are attached, the four sub tanks 142 are sequentially stacked on the outer side by using the adjustment brackets 250 having slightly larger sizes, in the same manner as described above. As another example, it may be possible to attach the plurality of sub tanks 142 on a plate of the single adjustment bracket 250.

Meanwhile, it may be possible to use, for example, liquid of four colors such as black K, cyan C, magenta M, and yellow Y, and other special kinds of liquid as the ink liquid to be discharged from each of the liquid heads. The types of the liquid are not limited to this example.

Modification of First Embodiment

Figure 17:
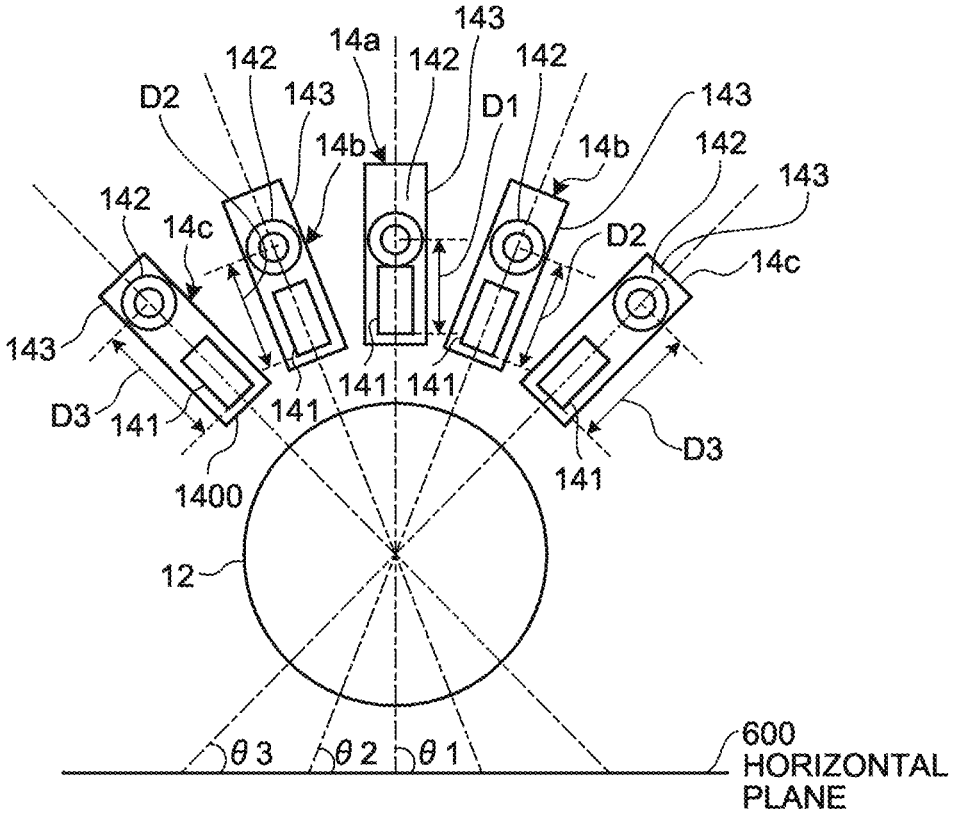
FIG. 17 is a diagram for explaining mounting positions of sub tanks in liquid discharge modules according to a modification of the first embodiment.

FIG. 17 is a diagram for explaining mounting positions of the sub tanks 142 in liquid discharge modules 14 according to a modification of the first embodiment. As illustrated in FIG. 17, each of the liquid discharge modules 14 is arranged at a different angle such that a perpendicular line extending from the discharge surface 1400 crosses the rotation axis of the conveying drum 12 at a right angle when the liquid discharge head 141 is attached. In other words, the liquid discharge modules 14 are arranged inside the image forming unit 10 such that angles between respective longitudinal sides of the liquid discharge modules 14 and the horizontal plane 600 become different from one another.

The holding member 143 of each of the liquid discharge modules 14*a*, 14*b*, and 14*c* holds the containing member 142 such that distances D1, D2, and D3 between the discharge surfaces 1400 of the liquid discharge heads 141 and the containing members in directions of perpendicular lines (chain lines in the figure) of the discharge surfaces 1400 are larger as angles 81, 82, and 83 between the perpendicular lines and the horizontal plane 600 on which the image forming apparatus 1 is set are smaller. In the present modification, while the positions of the sub tanks 142 in the vertical direction relative to the respective liquid discharge heads 141 in the liquid discharge modules 14*a*, 14*b*, and 14*c* are different, it is possible to prevent variation in the hydraulic head difference among the liquid discharge modules 14, as compared to a case in which the distances D1, D2, and D3 are set to be constant regardless of the angles θ1, θ2, and θ3. In other words, by adjusting the sub tanks 142 relative to the discharge surfaces 1400 in the direction of the perpendicular line, it is possible to prevent variation in the height between each of the nozzle arrays and each of the negative pressure generation positions in the vertical direction among the plurality of liquid discharge modules 14. With this configuration, it is possible to prevent variation in the hydraulic head difference among the liquid discharge modules 14.

In the present modification, the above-described relationship between the angle and the distance is satisfied for all of the five liquid discharge modules, but embodiments are not limited thereto. For example, in FIG. 17, the two liquid discharge modules, such as the single liquid discharge module in the center and the adjacent liquid discharge module, may be adopted as targets, and the holding members 143 may be configured to hold the containing members 142 such that the distances D1 and D2 between the discharge surfaces 1400 of the respective liquid discharge heads 141 and the containing members in the directions of the perpendicular lines are larger as the angles θ1 and θ2 with respect to the horizontal plane 600 are smaller.

While the example has been described in the above-described embodiments in which the plurality of liquid discharge modules 14 are arranged so as to face the conveying drum 12, embodiments are not limited thereto. In a configuration in which a conveying guide plate in a curved shape is arranged instead of the drum and a sheet is conveyed onto the conveying guide plate by a mechanism, such as a conveying roller, it may be possible to arrange a plurality of liquid discharge modules such that the liquid discharge modules face the conveying guide plate.

According to an embodiment of the present invention, it is possible to prevent variation in image quality among heads with a simple configuration.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An apparatus configured to discharge liquid comprising:

a plurality of liquid discharge modules arranged at different inclinations in the apparatus, wherein each of the plurality of liquid discharge modules comprises:

a liquid discharge head configured to discharge liquid;

a containing member arranged at a corresponding inclination for its liquid discharge module, configured to contain liquid to be supplied to the liquid discharge head; and a holding member configured to hold the containing member, and the holding member of each of the plurality of liquid discharge modules includes a first adjuster configured to adjust a position of the containing member relative to the liquid discharge head in a vertical direction in the apparatus.

2. The apparatus configured to discharge liquid according to claim 1, wherein the holding member includes a first holding member extending in a direction away from a conveying surface along which a discharge target to which the liquid is to be discharged is to be conveyed, and the first adjuster is configured to adjust a holding position of the containing member relative to the first holding member in the direction away from the conveying surface.

3. The apparatus configured to discharge liquid according to claim 1, wherein the holding member includes a second adjuster configured to adjust a position of the containing member in a rotation direction.

4. The apparatus configured to discharge liquid according to claim 3, wherein the holding member includes:

a first holding member extending in a direction away from a conveying surface along which a discharge target to which the liquid is to be discharged is to be conveyed, and a second holding member configured to hold the containing member and be held by the first holding member.

5. The apparatus configured to discharge liquid according to claim 4, wherein the first adjuster is configured to adjust a position of the second holding member relative to the first holding member in the direction away from the conveying surface, and the second adjuster is configured to adjust a position of the containing member relative to the second holding member in the rotation direction about an axis perpendicular to a conveying direction of the discharge target and a liquid discharge direction.

6. The apparatus configured to discharge liquid according to claim 4, wherein the first holding member includes a plurality of first mounting parts arranged in the direction away from the conveying surface, and the second holding member is configured to be mounted on any of the plurality of first mounting parts.

7. The apparatus configured to discharge liquid according to claim 4, wherein the second holding member includes a plurality of second mounting parts arranged in a circumferential direction about an axis perpendicular to a conveying direction of the discharge target and a liquid discharge direction, and the containing member is mounted on any of the plurality of second mounting parts.

8. The apparatus configured to discharge liquid according to claim 1, wherein the containing member is detachably attached to the holding member.

9. The apparatus configured to discharge liquid according to claim 1, wherein the plurality of liquid discharge modules are arranged along a conveying surface along which a discharge target to which the liquid is to be discharged is to be conveyed, at the inclinations in accordance with a curved surface of the conveying surface.

10. The apparatus configured to discharge liquid according to claim 1, wherein the containing member includes a flexible film at a side surface of the containing member, the liquid discharge head includes a nozzle array arranged in a predetermined direction, and the side surface faces in the predetermined direction.

11. The apparatus configured to discharge liquid according to claim 1, wherein each of the plurality of liquid discharge modules includes a liquid supply path configured to supply liquid from the containing member to the liquid discharge head.

12. The apparatus configured to discharge liquid according to claim 1, wherein the inclinations of the plurality of liquid discharge modules in the apparatus are different between different colors of liquid to be discharged from the liquid discharge head.

13. The apparatus configured to discharge liquid according to claim 1, wherein the holding member of each of the plurality of liquid discharge modules is configured to hold the containing member such that a position of the containing member relative to the liquid discharge head in the vertical direction in the apparatus is equivalent among the plurality of liquid discharge modules.

14. An apparatus configured to discharge liquid comprising:

a plurality of liquid discharge modules arranged at different inclinations in the apparatus, wherein each of the plurality of liquid discharge modules includes:

a liquid discharge head configured to discharge liquid;

a containing member configured to contain liquid to be supplied to the liquid discharge head; and a holding member configured to hold the containing member, and the holding member of each of the plurality of liquid discharge modules is configured to hold the containing member such that a position of the containing member relative to the liquid discharge head in a vertical direction in the apparatus is equivalent among the plurality of liquid discharge modules.

15. An apparatus configured to discharge liquid comprising:

a plurality of liquid discharge modules arranged at different inclinations in the apparatus, wherein each of the plurality of liquid discharge modules includes:

a liquid discharge head configured to discharge liquid;

a containing member configured to contain liquid to be supplied to the liquid discharge head; and a holding member configured to hold the containing member, and the holding member of each of the plurality of liquid discharge modules is configured to hold the containing member such that a distance between a discharge surface of the liquid discharge head and the containing member in a direction of a perpendicular line of the discharge surface is larger as an angle between the perpendicular line and a horizontal plane on which the apparatus is set is smaller.

* * * * *